US010087565B2

(12) United States Patent
Janke et al.

(10) Patent No.: US 10,087,565 B2
(45) Date of Patent: Oct. 2, 2018

(54) LAUNDRY TREATING APPLIANCE AND METHODS OF OPERATION

(71) Applicant: WHIRLPOOL CORPORATION, Benton Harbor, MI (US)

(72) Inventors: Brian P. Janke, Saint Joseph, MI (US); Stephen L. Keres, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/937,203

(22) Filed: Mar. 27, 2018

(65) Prior Publication Data

US 2018/0216274 A1 Aug. 2, 2018

Related U.S. Application Data

(62) Division of application No. 14/945,903, filed on Nov. 19, 2015, now Pat. No. 9,988,753.

(51) Int. Cl.

| | |
|---|---|
| ***D06F 33/02*** | (2006.01) |
| ***D06F 35/00*** | (2006.01) |
| ***D06F 37/04*** | (2006.01) |
| ***D06F 37/12*** | (2006.01) |

(Continued)

(52) U.S. Cl.

CPC ..... *D06F 37/304* (2013.01); *D06F 33/02* (2013.01); *D06F 35/005* (2013.01); *D06F 37/04* (2013.01); *D06F 37/12* (2013.01); *D06F 37/203* (2013.01); *D06F 2202/065* (2013.01); *D06F 2204/065* (2013.01); *D06F 2222/00* (2013.01)

(58) Field of Classification Search

CPC ..... D06F 33/02; D06F 35/005; D06F 37/04; D06F 37/12; D06F 37/203; D06F 37/304; D06F 2202/065; D06F 2204/065; D06F 2222/00

USPC ..... 8/158, 159; 68/12.02, 12.04, 12.06, 68/12.21, 12.27

See application file for complete search history.

(56) References Cited

U.S. PATENT DOCUMENTS

| | | | |
|---|---|---|---|
| 4,782,544 | A | 11/1988 | Nystuen et al. |
| 5,293,760 | A | 3/1994 | Tani et al. |
| 5,692,313 | A | 12/1997 | Ikeda et al. |

(Continued)

FOREIGN PATENT DOCUMENTS

| | | | |
|---|---|---|---|
| CA | 2411700 | A1 | 6/2003 |
| DE | 19802650 | A1 | 7/1999 |

(Continued)

*Primary Examiner* — Levon J Shahinian

(57) ABSTRACT

A laundry treating appliance includes a drum at least partially defining a treating chamber for receiving a laundry load for treatment according to a cycle of operation, a motor operably coupled with the drum to rotate the drum, a controller coupled to the motor for controlling the motor and for determining at least one input sensed from the motor, and a processor operably coupled with the controller and having a parameter estimator to estimate parameter values of a laundry load based upon the at least one input. The processor is configured to send an excitation signal to the controller that randomly fluctuates an acceleration command to affect acceleration of the motor while the parameter values of the laundry load are estimated. The cycle of operation can then be adjusted based on the estimated parameter values of the laundry load.

20 Claims, 24 Drawing Sheets

(51) Int. Cl.
*D06F 37/20* (2006.01)
*D06F 37/30* (2006.01)

(56) References Cited

U.S. PATENT DOCUMENTS

| | | | |
|---|---|---|---|
| 5,765,402 | A | 6/1998 | Ikeda et al. |
| 5,893,280 | A | 4/1999 | Honda et al. |
| 5,905,648 | A | 5/1999 | Badami |
| 6,393,918 | B2 | 5/2002 | French et al. |
| 6,505,369 | B1 | 1/2003 | Weinmann |
| 6,633,149 | B1 | 10/2003 | Foureys |
| 7,162,759 | B2 | 1/2007 | Weinmann |
| 7,296,445 | B2 | 11/2007 | Zhang et al. |
| 7,380,303 | B2 | 6/2008 | Bellinetto et al. |
| 7,591,038 | B2 | 9/2009 | Murray et al. |
| 7,905,122 | B2 | 3/2011 | Murray et al. |
| 7,958,585 | B2 | 6/2011 | Zhang et al. |
| 8,122,549 | B2 | 2/2012 | Park et al. |
| 8,186,227 | B2 | 5/2012 | Ashrafzadeh |
| 8,250,690 | B2 | 8/2012 | Jurmann et al. |
| 8,312,581 | B2 | 11/2012 | Pelczer |
| 8,489,358 | B2 | 7/2013 | Petronilho et al. |
| 8,819,880 | B2 | 9/2014 | Ashrafzadeh et al. |
| 8,875,332 | B2 | 11/2014 | Janke et al. |
| 8,910,335 | B2 | 12/2014 | Kim et al. |
| 8,943,629 | B2 | 2/2015 | Paul et al. |
| 8,984,693 | B2 | 3/2015 | Ashrafzadeh et al. |
| 9,010,159 | B2 | 4/2015 | Sharp |
| 9,080,277 | B2 | 7/2015 | Erickson et al. |
| 9,091,011 | B2 | 7/2015 | Janke et al. |
| 9,091,012 | B2 | 7/2015 | Ashrafzadeh et al. |
| 9,096,964 | B2 | 8/2015 | Albayrak et al. |
| 2003/0115682 | A1 | 6/2003 | Gardner |
| 2006/0242768 | A1 | 11/2006 | Zhang et al. |
| 2008/0041115 | A1 | 2/2008 | Kanazawa et al. |
| 2008/0041116 | A1 | 2/2008 | Kanazawa et al. |
| 2008/0178398 | A1 | 7/2008 | Darby et al. |
| 2009/0106913 | A1 | 4/2009 | Suel, II et al. |
| 2009/0308110 | A1 | 12/2009 | Koo et al. |
| 2011/0067185 | A1 | 3/2011 | Koo et al. |
| 2012/0144599 | A1 | 6/2012 | Polli et al. |
| 2012/0151686 | A1 | 6/2012 | Jang et al. |
| 2012/0151693 | A1 | 6/2012 | Jang et al. |
| 2012/0151694 | A1 | 6/2012 | Jang et al. |
| 2012/0246835 | A1 | 10/2012 | Ashrafzadeh et al. |
| 2013/0000054 | A1 | 1/2013 | Zasowksi |
| 2013/0031939 | A1 | 2/2013 | Hasanreisoglu et al. |
| 2013/0047344 | A1 | 2/2013 | Janke et al. |
| 2013/0152311 | A1 | 6/2013 | Janke et al. |
| 2013/0152312 | A1* | 6/2013 | Janke ..... D06F 33/02 8/137 |
| 2013/0160220 | A1 | 6/2013 | Ashrafzadeh et al. |
| 2013/0160221 | A1 | 6/2013 | Ashrafzadeh et al. |
| 2013/0160498 | A1 | 6/2013 | Erickson et al. |
| 2014/0013518 | A1 | 1/2014 | Erickson et al. |
| 2014/0215725 | A1 | 8/2014 | Paglia et al. |
| 2014/0318246 | A1 | 10/2014 | Miyaji |
| 2014/0379142 | A1 | 12/2014 | Borlin et al. |
| 2015/0047396 | A1 | 2/2015 | Beckert Polli et al. |
| 2015/0101668 | A1 | 4/2015 | Janke et al. |

FOREIGN PATENT DOCUMENTS

| | | | |
|---|---|---|---|
| DE | 102012223611 | A1 | 6/2014 |
| DE | 102014109650 | A1 | 2/2015 |
| EP | 0433157 | A1 | 6/1991 |
| EP | 0494667 | A1 | 7/1992 |
| EP | 0704568 | B1 | 12/1998 |
| EP | 0921226 | A2 | 6/1999 |
| EP | 1350881 | A1 | 10/2003 |
| EP | 1734167 | A1 | 12/2006 |
| EP | 2607536 | A1 | 6/2013 |
| EP | 2765230 | A1 | 8/2014 |
| JP | 05277289 | A | 10/1993 |
| WO | 2004097099 | A1 | 11/2004 |

* cited by examiner

LAUNDRY TREATING APPLIANCE AND METHODS OF OPERATION

CROSS-REFERENCE TO RELATED APPLICATIONS

This application is a divisional application of U.S. patent application Ser. No. 14/945,903, entitled "Laundry Treating Appliance and Methods of Operation," filed Nov. 19, 2015, now U.S. Pat. No. 9,988,753, issued Jun. 5, 2018, which is incorporated herein by reference in its entirety.

BACKGROUND

Laundry treating appliances, such as washing machines, refreshers, and non-aqueous systems, can have a configuration based on a rotating container that defines a treating chamber in which laundry items are placed for treating. In a vertical axis washing machine, the container is in the form of a perforated basket located within a tub; both the basket and tub typically have an upper opening at their respective upper ends. In a horizontal axis washing machine, the container is in the form of a perforated drum located within a tub; both the drum and tub typically have an opening at their respective front facing ends. The laundry treating appliance can have a controller that implements the cycles of operation having one or more operating parameters. The controller can control a motor to rotate the container according to one of the cycles of operation. Considering that sensors add cost to a product, any method that can provide equivalent or better performance without using sensors can enable a cost reduction without negatively impacting capability (and potentially improving capability). Parameter estimation can be used to monitor and optimize the cycles of operation.

BRIEF SUMMARY

In one aspect, a laundry treating appliance includes a drum at least partially defining a treating chamber for receiving a laundry load for treatment according to a cycle of operation, and a motor operably coupled with the drum to rotate the drum. A controller is coupled to the motor for controlling the motor and for determining at least one input sensed from the motor. A processor is operably coupled with the controller and has a parameter estimator to estimate parameter values of a laundry load based upon the at least one input. The processor is configured to send an excitation signal to the controller that randomly fluctuates an acceleration command to affect acceleration of the motor while the parameter values of the laundry load are estimated. The cycle of operation can then be adjusted based on the estimated parameter values of the laundry load.

DETAILED DESCRIPTION

Figure 1:
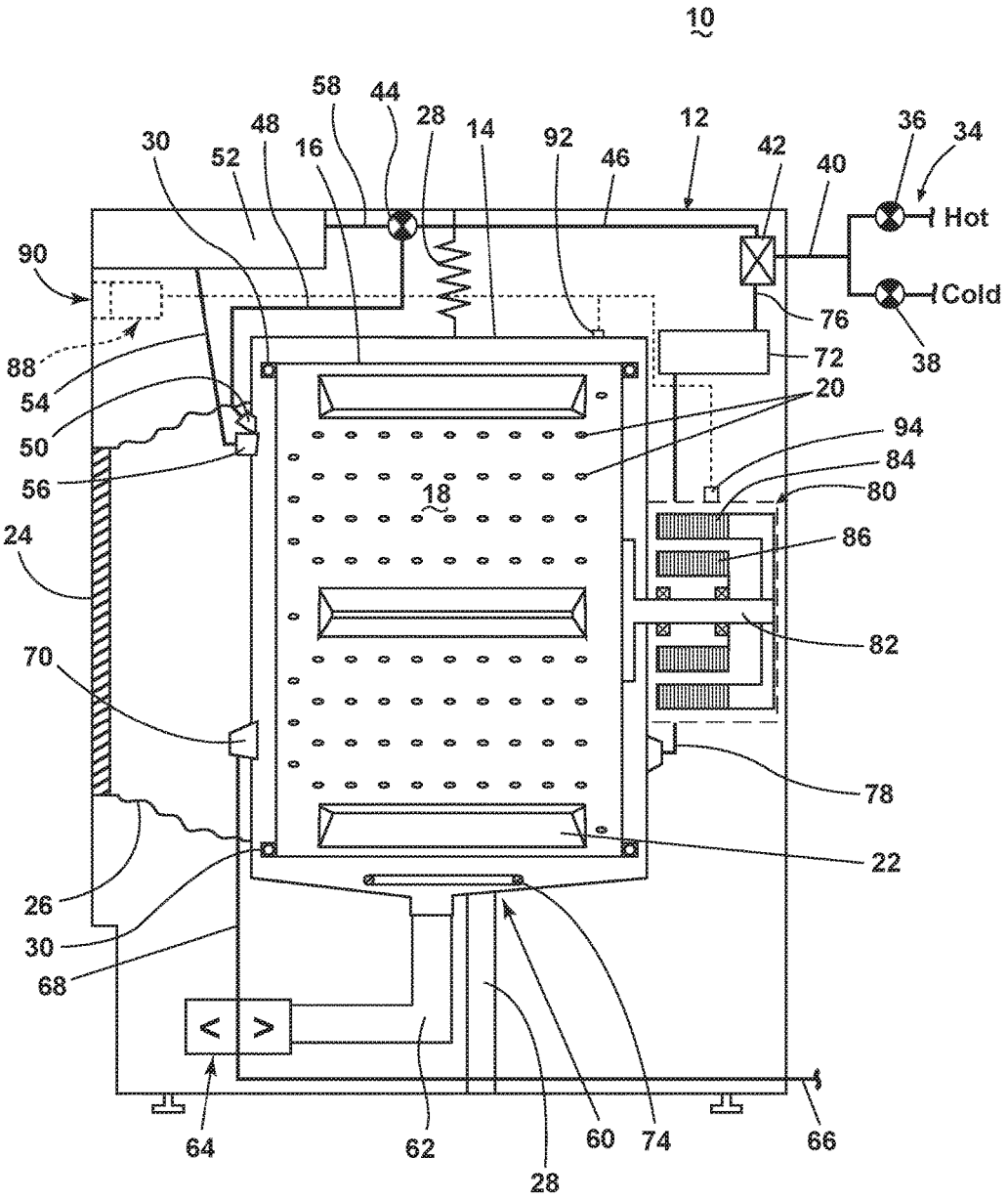
FIG. 1 is a schematic view of a laundry treating appliance in the form of a horizontal washing machine.

Embodiments of the invention relate to the use of parameter estimation algorithms in the context of a washing machine and its corresponding cycles of operation. Some parameters related to the operation of a washing machine can be directly measured or calculated, e.g., torque, motor speed, drum speed, or drum position. Parameter estimation can be used to estimate a variety of parameters related to the operation of a washing machine based on measured parameters, nonlimiting examples of which include inertia, friction, drag events, position and magnitude of a laundry load imbalance or position and magnitude of an unbalanced mass in a balancer device. Parameter estimation can identify a variety of laundry load characteristics and can be used to improve the operation of a washing machine, to optimize cycle time and/or machine stresses, and to improve efficiency of the cycles operated by the washing machine. The embodiments of the invention disclosed herein detail different methods for both using the outputs of a parameter estimator to improve operation of a washing machine and improving the values being outputted by a parameter estimator for the enrichment and improvement of overall parameter estimation functions.

Functions and applications of parameter estimation contemplated in this disclosure include, but are not limited to, real-time monitoring of inertia to determine a threshold for a final spin speed plateau, determination of an angular location of an imbalance in real time to improve re-distribution of the imbalance, continuous monitoring of friction values for quick detection of undesirable friction or drag events, estimation of a wet-to-dry factor, water extraction rate, or load absorbance rate by monitoring of inertia to determine a final spin speed for energy efficient water extraction, improvement of wet load inertia estimation using a covariance resetting algorithm scheduled around an auxiliary machine component operation, wherein the auxiliary machine component may be comprised of a drain pump, a recirculation pump, a water valve or any other component that may introduce a fluctuating rotational drag on the drum, imposing an excitation sequence on the input of a speed controller of a washing machine to improve richness of parameter estimation signals, and using a geometric transformation to improve inertia estimation and account for changes in load geometry in order to better identify a load mass.

As described herein, the term "imbalance" or "unbalance," when used alone or in combination with the words "condition", "mass", "phase", "magnitude", "position," or otherwise, refers to an object being in a state of unbalance relative to its respective reference frame, i.e., an object positioned in a washing machine so as to shift the center of gravity, or the orientation of the principal axis, of a rotating inertia away from the longitudinal axis of the rotating shaft in the washing machine. The term "ramp" refers to a portion of a speed profile where the drum is accelerating. The term "dwell" refers to a portion of a speed profile where the drum speed is generally constant, though it will be understood that the term "dwell speed" is not limited a fixed speed but may include a slow change in speed over a given time. For example, a slow change in speed, either increasing or decreasing, over a given time may be considered a dwell speed. The term "dwell" may also include a small, zero-mean excitation perturbation added to a constant speed profile, with the purpose of achieving a sufficient level of signal richness required for parameter estimation convergence.

Embodiments of the invention can be utilized with a laundry treating appliance in the form of a horizontal-axis washing machine 10 as illustrated in FIG. 1. The horizontal-axis washing machine 10 is exemplary, and use with a laundry treating appliance varying from a horizontal-axis relative to a surface upon which it rests is contemplated, including for example, a vertical-axis washing machine. The horizontal-axis washing machine 10 can be operated, according to embodiments of the invention, for improved parameter estimation performance. A structural support system including a cabinet 12 can define a housing within which a laundry holding system resides. The cabinet 12 can be a housing having a chassis and/or a frame, defining an interior, enclosing components typically found in a conventional washing machine, such as motors, pumps, fluid lines, controls, sensors, transducers, and the like. Such components will not be described further herein except as necessary for a complete understanding of the invention.

The laundry holding system includes a tub 14 supported within the cabinet 12 by a suitable suspension system and a rotatable laundry-container in the form of a drum 16 provided within the tub 14. The drum 16 defines at least a portion of a laundry treating chamber 18 for receiving a laundry load for treatment. The drum 16 can include a plurality of perforations 20 such that liquid can flow between the tub 14 and the drum 16 through the perforations 20. A plurality of baffles 22 can be disposed on an inner surface of the drum 16 to lift the laundry load received in the treating chamber 18 while the drum 16 rotates. It can also be within the scope of the invention for the laundry holding system to include only a tub with the tub defining the laundry treating chamber.

The laundry holding system can further include a door 24 which can be movably mounted to the cabinet 12 to selectively close both the tub 14 and the drum 16. A bellows 26 can couple an open face of the tub 14 with the cabinet 12, with the door 24 sealing against the bellows 26 when the door 24 closes the tub 14. The washing machine 10 can further include a suspension system 28 for dynamically suspending the laundry holding system within the structural support system.

The washing machine 10 can also include at least one balance ring 30 containing a balancing material moveable within the balance ring 30 to counterbalance an imbalance that can be caused by a load of laundry in the treating chamber 18 during rotation of the drum 16. More specifically, the balance ring 30 can be coupled with the rotating drum 16 and configured to compensate for an imbalance in the load during rotation of the rotatable drum 16. The balance ring 30 can extend circumferentially around a periphery of the drum 16 and can be located at any desired location along an axis of rotation of the drum 16. While one balance ring 30 is shown mounted to the front end of the drum 16, multiple balance rings 30 are contemplated. When multiple balance rings 30 are present, they can be equally spaced along the axis of rotation of the drum 16. For example, if two balance rings 30 are utilized, they can be operably coupled with opposite ends of the rotatable drum 16.

The washing machine 10 can further include a liquid supply system for supplying water to the washing machine 10 for use in treating laundry during a cycle of operation. The liquid supply system can include a source of water, such as a household water supply 34, which can include separate valves 36 and 38 for controlling the flow of hot and cold water, respectively. Water can be supplied through an inlet conduit 40 directly to the tub 14 by controlling first and second diverter mechanisms 42 and 44, respectively. The diverter mechanisms 42, 44 can be a diverter valve having two outlets such that the diverter mechanisms 42, 44 and can selectively direct a flow of liquid to one or both of two flow paths. Water from the household water supply 34 can flow through the inlet conduit 40 to the first diverter mechanism 42 which can direct the flow of liquid to a supply conduit 46.

The second diverter mechanism 44 on the supply conduit 46 can direct the flow of liquid to a tub outlet conduit 48 which can be provided with a spray nozzle 50 configured to spray the flow of liquid into the tub 14. In this manner, water from the household water supply 34 can be supplied directly to the tub 14.

The washing machine 10 can also be provided with a dispensing system for dispensing treating chemistry to the treating chamber 18 for use in treating the laundry according to a cycle of operation. The dispensing system can include a dispenser 52 which can be a single use dispenser, a bulk dispenser or a combination of a single use and bulk dispenser.

Regardless of the type of dispenser used, the dispenser 52 can be configured to dispense a treating chemistry directly to the tub 14 or mixed with water from the liquid supply system through a dispensing outlet conduit 54. The dispensing outlet conduit 54 can include a dispensing nozzle 56 configured to dispense the treating chemistry into the tub 14 in a desired pattern and under a desired amount of pressure. For example, the dispensing nozzle 56 can be configured to dispense a flow or stream of treating chemistry into the tub 14 by gravity, i.e. a non-pressurized stream. Water can be supplied to the dispenser 52 from the supply conduit 46 by directing the diverter mechanism 44 to direct the flow of water to a dispensing supply conduit 58.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 can also include a recirculation and drain system for recirculating liquid within the laundry holding system and draining liquid from the washing machine 10. Liquid supplied to the tub 14 through tub outlet conduit 48 and/or the dispensing supply conduit 58 typically enters a space between the tub 14 and the drum 16 and can flow by gravity to a sump 60 formed in part by a lower portion of the tub 14. The sump 60 can also be formed by a sump conduit 62 that can fluidly couple the lower portion of the tub 14 to a pump 64. The pump 64 can direct liquid to a drain conduit 66, which can drain the liquid from the washing machine 10, or to a recirculation conduit 68, which can terminate at a recirculation inlet 70. The recirculation inlet 70 can direct the liquid from the recirculation conduit 68 into the drum 16. The recirculation inlet 70 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the laundry within.

The liquid supply and/or recirculation and drain system can be provided with a heating system which can include one or more devices for heating laundry and/or liquid supplied to the tub 14, such as a steam generator 72 and/or a sump heater 74. Liquid from the household water supply 34 can be provided to the steam generator 72 through the inlet conduit 40 by controlling the first diverter mechanism 42 to direct the flow of liquid to a steam supply conduit 76. Steam generated by the steam generator 72 can be supplied to the tub 14 through a steam outlet conduit 78. The steam generator 72 can be any suitable type of steam generator such as a flow through steam generator or a tank-type steam generator. Alternatively, the sump heater 74 can be used to generate steam in place of or in addition to the steam generator 72. In addition or alternatively to generating steam, the steam generator 72 and/or sump heater 74 can be used to heat the laundry and/or liquid within the tub 14 as part of a cycle of operation.

Additionally, the liquid supply and recirculation and drain system can differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system can include a motor 80 for rotationally driving the drum 16. The motor 80 can be directly coupled with the drum 16 through a drive shaft 82 to rotate the drum 16 about a rotational axis during a cycle of operation. The motor 80 can be a brushless permanent magnet (BPM) motor having a stator 84 and a rotor 86. Alternately, the motor 80 can be coupled with the drum 16 through a belt and a drive shaft to rotate the drum 16, as is known in the art. Other motors, such as an induction motor or a permanent split capacitor (PSC) motor, can also be used. The motor 80 can rotationally drive the drum 16 including that the motor 80 can rotate the drum 16 at various speeds in either rotational direction. The motor 80 can be configured to rotatably drive the drum 16 in response to a motor control signal.

The washing machine 10 also includes a control system for controlling the operation of the washing machine 10 to implement one or more cycles of operation. The control system can include a controller 88 located within the cabinet 12 and a user interface 90 that is operably coupled with the controller 88. The user interface 90 can include one or more knobs, dials, switches, displays, touch screens, and the like for communicating with the user, such as to receive input and provide output. The user can enter different types of information including, without limitation, cycle selection and cycle parameters, such as cycle options.

The controller 88 can include the machine controller and any additional controllers provided for controlling any of the components of the washing machine 10. For example, the controller 88 can include the machine controller and a motor controller. Many known types of controllers can be used for the controller 88. It is contemplated that the controller can be a microprocessor-based controller that implements control software and sends/receives one or more electrical signals to/from each of the various working components to effect the control software.

The controller 88 can also be coupled with one or more sensors 92, 94 provided in one or more of the systems of the washing machine 10 to receive input from the sensors, which are known in the art and not shown for simplicity. Non-limiting examples of sensors 92, 94 that can be communicably coupled with the controller 88 include: a treating chamber temperature sensor, a moisture sensor, a weight sensor, a chemical sensor, a position sensor, an acceleration sensor, a speed sensor, an orientation sensor, an imbalance sensor, a load size sensor, and a motor torque sensor, which can be used to determine a variety of system and laundry characteristics, such as laundry load inertia or mass and system imbalance magnitude and position.

For example, a motor torque sensor, a speed sensor, an acceleration sensor, and/or a position sensor can also be included in the washing machine 10 and can provide an output or signal indicative of the torque applied by the motor, a speed of the drum 16 or component of the drive system, an acceleration of the drum 16 or component of the drive system, and a position sensor of the drum 16. Such sensors 92, 94 can be any suitable types of sensors including, but not limited to, that one or more of the sensors 92, 94 can be a physical sensor or can be integrated with the motor and combined with the capability of the controller 88 to function as a sensor. For example, motor characteristics, such as speed, current, voltage, torque etc., can be processed such that the data provides information in the same manner as a separate physical sensor. In contemporary motors, the motors often have their own controller that outputs data for such information.

Figure 2:
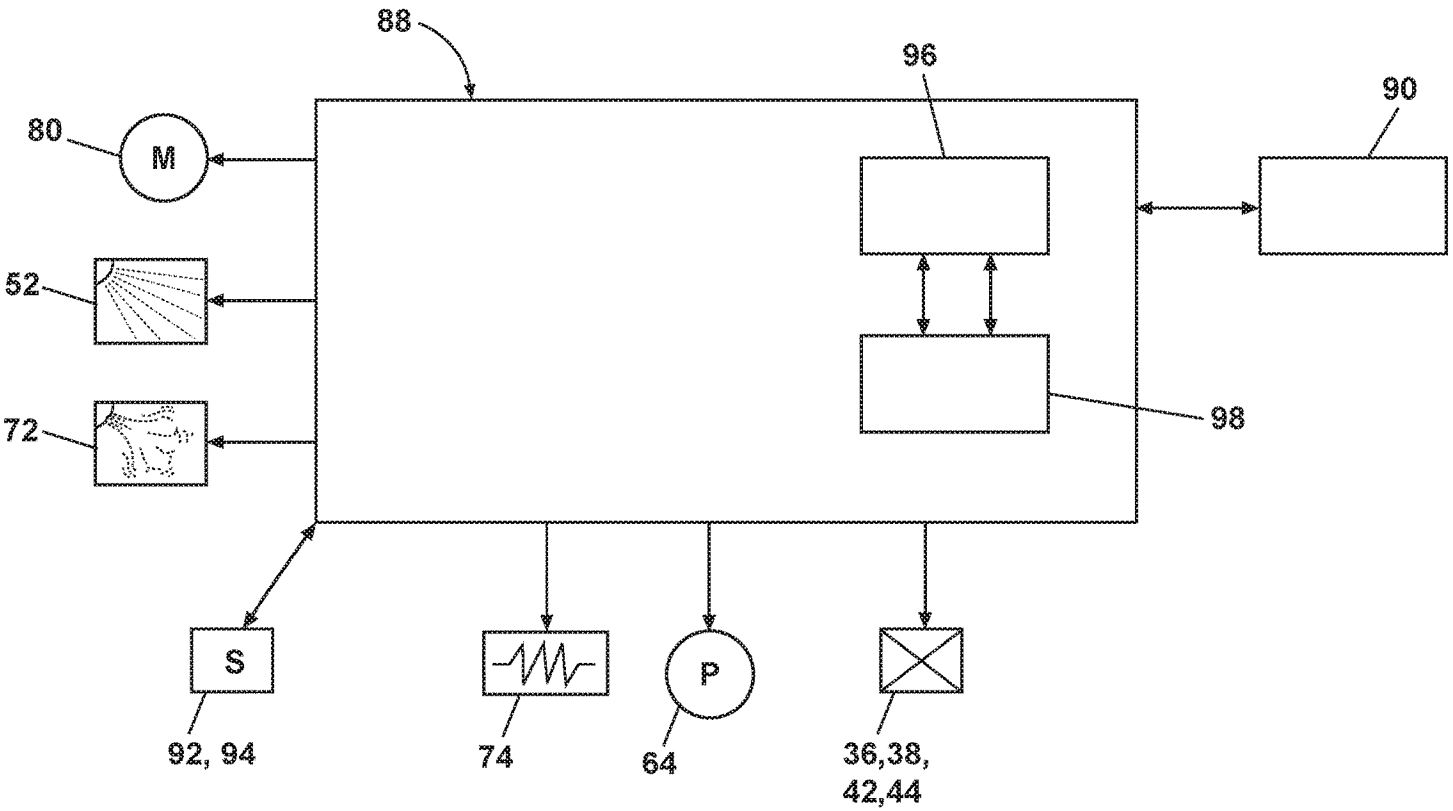
FIG. 2 is a schematic of a control system for the laundry treating appliance of FIG. 1.

As illustrated in FIG. 2, the controller 88 can be provided with a memory 96 and a central processing unit (CPU) 98. The memory 96 can be used for storing the control software that can be executed by the CPU 98 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 96 can also be used to store information, such as a database or table, and to store data received from one or more components or sensors 92, 94 of the washing machine 10 that can be communicably coupled with the controller 88. The database or table can be used to store the various operating parameters for the one or more cycles of operation, including factory default values for the operating parameters and any adjustments to them by the control system or by user input. Such operating parameters and information stored in the memory 96 can include, but are not limited to, acceleration ramps, threshold values, predetermined criteria, etc.

The controller 88 can be operably coupled with one or more components of the washing machine 10 for communicating with and controlling the operation of the component to complete a cycle of operation. For example, the controller 88 can be operably coupled with the motor 80, the pump 64, the dispenser 52, the steam generator 72 and the sump heater 74 to control the operation of these and other components to implement one or more of the cycles of operation.

Parameter Estimation Models

During operation of the washing machine 10, the controller 88 can be configured to output a motor control signal to the motor 80 to rotate the drum 16. When the drum 16 with the laundry load mass rotates during a cycle of operation, the load mass within the interior of the drum 16 is a part of the inertia of the rotating system of the drum 16, along with other rotating components of the laundry treating appliance. By utilizing a parameter estimator, such as by estimation or calculation, the motor torque, acceleration of the drum 16, speed of the drum 16, and angular position of the drum 16, can be used to determine several parameters, including inertia, mechanical and viscous frictional forces, magnitude of a load imbalance, and position of a load imbalance relative to the position of the drum 16. Sensors disposed within the laundry treating appliance can be utilized to determine motor torque, acceleration, speed, and position of the drum. Exemplary sensors include a motor torque sensor for determining torque and laser sensors or encoders to determine acceleration, speed, and position of the drum 16. Alternatively, torque, speed, and position of the drum can be estimated utilizing an observer with measured inputs such as current and voltage.

Generally the relationship between motor torque for rotating the drum 16 and parameters relevant to the operation of a washing machine 10 can be represented in the following equation:

$$\tau=J\omega'+b*\omega+C+A*\sin(\alpha+\beta), \quad (1)$$

where, $\tau$=torque, J=inertia, $\omega'$=angular acceleration, $\omega$=angular speed, b=viscous friction, C=coulomb friction, A=amplitude of a basket speed first harmonic torque disturbance, which may be a function of the unbalance mass, surface tilt angle, gravitational acceleration, unbalance mass position, suspension asymmetries, basket speed, or other causes of conservative drag effects (i.e., rotational drag that depends on rotational position of the drum) $\alpha$=angular position of the rotating drum, and $\beta$=angular position of the effective unbalance relative to the rotating drum. It will be understood that equivalents may be applicable. For example, in a horizontal axis washing machine, A=m*g*r, where m=mass of the imbalance, g=gravity, r=radius from the center of rotation to the effective unbalance.

The mathematical model of the washing machine 10, namely equation (1), describes a relationship between estimated parameters and measured parameters. As described above, measured parameters may include torque, acceleration, speed or position of the drum, and even some of those may be estimated from measured currents or voltages. Estimated parameters may include inertia, viscous friction, coulomb friction, mass of an imbalance, mechanical losses, or an angular position of an effective unbalance relative to the rotating drum. Any suitable methodology or algorithm, proprietary or known, including, but not limited to a recursive least squares algorithm can be used to estimate the parameters in such a model. Thus, during operation, the controller 88, utilizing parameter estimation, can monitor over time one or more of a torque signal, a speed signal, an acceleration signal, or a position signal during the rotation of the drum 16. The controller 88 can also make repeated determinations or estimates of other parameters, which can be done continuously or periodically.

An additional form of difficulty may exist in a washing machine 10 with balance rings 30 because balance rings 30 add to or subtract from the load unbalance, which is especially apparent at speeds where the centrifugal force is not to enough to force the balance mass to a position opposite the unbalance. Balance rings may comprise any type of dynamic balancer structure, including but not limited to ball balance rings, or fluid balance rings. In this case, an alternate model can be used which enables use of the above disclosed method in a machine with balance rings 30 using a balance mass (e.g., balls or a fluid) by allowing for the de-coupling of the unbalance generated by the balance mass of the balance rings 30 from the unbalance generated by the load. To accomplish this, the rotational position of the drum 16 can be utilized to determine the position of the reference axis, the magnitude of the balance mass imbalance, and the position of the balance mass, where the magnitude of the balance mass can be a representation of how grouped or spread the mass is within the ring.

Generally the relationship between motor torque for rotating the drum 16 and parameters relevant to an off-balance laundry load can be represented in the following equation:

$$\tau=J\dot{\omega}+b\omega+c+A\sin(\alpha+\beta)+B\sin(\alpha_{BB}+\beta_{BB}), \quad (2)$$

where, $\tau$=torque, J=inertia, $\dot{\omega}$=acceleration, $\omega$=rotational speed, b=viscous friction, c=coulomb friction, A=amplitude of a basket speed first harmonic torque disturbance, which may be a function of the unbalance mass, surface tilt angle, gravitational acceleration, unbalance mass position, suspension asymmetries, basket speed, or other causes of conservative drag effects (i.e., rotational drag that depends on rotational position of the drum), $\alpha$=rotational position of the drum, $\beta$=rotational position of the load imbalance mass relative to the rotational position of the drum, B=amplitude of a balancer disturbance, which may be a function of unbalance mass in the balancer, surface tilt angle, gravitational acceleration, unbalance mass position, basket speed, or other causes of conservative drag effects on the balance mass, $\alpha_{BB}$=rotational position reference for the balance mass relative to a fixed axis, and $\beta_{BB}$=rotational position of the center of mass of the balance mass relative to the rotational reference position $\alpha_{BB}$. The parameter $\alpha_{BB}$ can be expressed as a tunable function of a such as $\alpha_{BB}=\alpha\cdot(k)$, for example, where the factor k can be tuned based upon exemplary conditions of the washing machine 10 such as the temperature, rotational speed, or balance ring physical characteristics. As such, $\alpha$ can be used determine to $\alpha_{BB}$ by utilizing sensors or a mathematical model operating within a controller. Alternatively, $\alpha_{BB}$ could be a measured value in the case that a balance mass such as balance balls were measured as may be the case with magneto sensors.

It will be understood that equivalents may be applicable. For example, in a horizontal axis washing machine, A=m*g*r, where m=mass of the load imbalance, g=gravity, r=radius from the center of rotation to the effective load unbalance, and $B_{BB}=m_{BB}gr_{BB}$, where $m_{BB}$ mass at the center of the balance mass, g=gravity, and $r_{BB}$=radius from the center point of the drum to the center of mass of the balance mass.

Additionally, $(\alpha+\beta)$ where a is the rotational position, plus $\beta$, which is the imbalance phase angle, represents the rotational position of the imbalance load mass. $(\alpha_{BB}+\beta_{BB})$, where $\alpha_{BB}$ is the reference angle, plus $\beta_{BB}$, which is the balancer phase angle, represents the rotational position of the balance mass.

Furthermore, mgr can represent the magnitude of the moment generated by the imbalance of the load mass about an axis through the center point as determined by the mass of the imbalance, the radius of the imbalance load mass from the center point, and the gravitational acceleration acting on the imbalance load mass. Similarly, $m_{BB}gr_{BB}$ can represent the magnitude of the moment generated by the imbalance of the balance mass about an axis through the center point.

Utilizing a parameter estimator, multiple sensor measurements for the torque, acceleration, speed, and position of the drum 16 can be used to determine the position and magnitude of the unbalance and the position and magnitude of the balancer mass. Similar to equation (1), the mathematical model of the washing machine 10, namely equation (2), describes a relationship between estimated parameters and measured parameters. As described above, measured parameters may include torque, acceleration, speed or position of the drum, and even some of those may be estimated from measured currents or voltages. Estimated parameters may include viscous friction, coulomb friction, mass of an imbalance load, an angular position of an effective imbalance load relative to the rotating drum, a mass of a balancer imbalance, or an angular position of an effective balancer imbalance relative to the rotating drum. Any suitable methodology or algorithm, proprietary or known, such as a recursive least squares algorithm can be used to estimate the parameters in such a model.

Thus, during operation, the controller 88, utilizing parameter estimation, can monitor over time a torque signal, a speed signal, an acceleration signal, and a position signal during the rotation of the drum 16. The controller 88 can also repeatedly determine or estimate the position and magnitude of the load mass and the balancer mass as well as friction terms and rotational inertia, which can be done continuously or periodically. Such magnitude and position can be repeatedly determined and from the monitored values.

Inertia Monitoring to Adapt Final Spin Speed Plateau

During operation of the washing machine 10, the controller 88 typically has pre-defined profiles that determine a maximum speed during the liquid extraction phase. Once the washing machine 10 has achieved the maximum allowable spinning speed, the spin will dwell at that speed for a pre-determined amount of time, which is typically set such that the dwell would be of sufficient length to achieve the target remaining moisture content (RMC) assuming a targeted load composition. This means the cycle may not be optimized for varying load absorbency cases, which can result in not extracting enough liquid, or spinning past the point of benefit. For example, if every load were spun to maximum speed for maximum duration, when a low absorbent load of laundry is spun, then the pre-determined dwell speed and length of dwell time may result in the load being spun past the point of benefit because the low absorbency load may have already achieved the RMC at a lower speed many minutes earlier. This results in a waste of time and energy of the washing machine 10.

Figure 3:
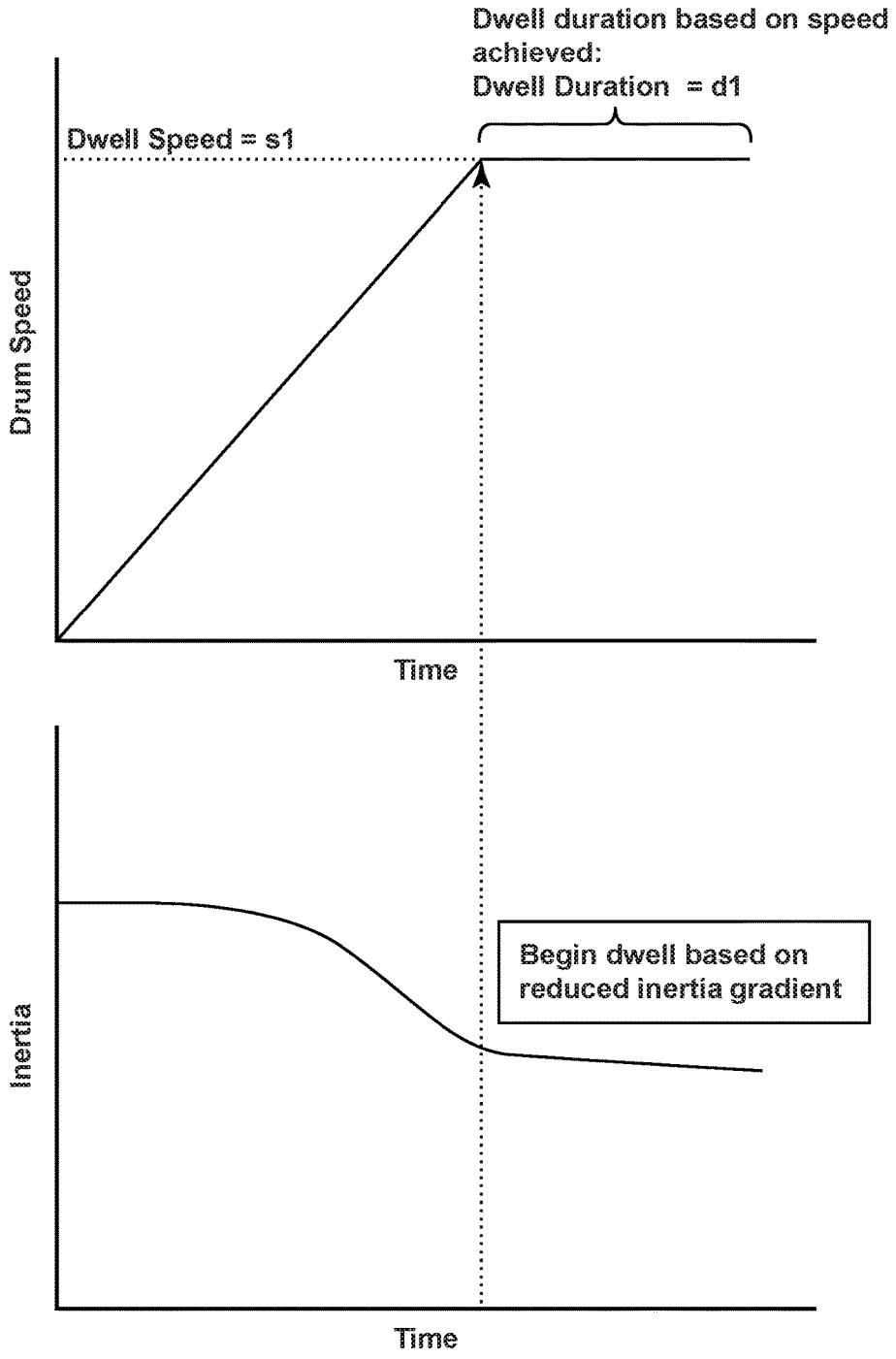
FIG. 3 is a series of two plots illustrating rotational speed of a drum over time during a liquid extraction phase of a high absorbent load and the inertia of the drum over time during the same liquid extraction phase.

The previously described washing machine 10 can be used to implement one or more embodiments of a method of the invention to allow individual loads to be treated differently. Referring now to FIG. 3, the upper plot illustrates the speed of rotation of the drum as time progresses in the liquid extraction phase of the washing machine 10. In this example, the drum speed increases at a steady rate until a dwell speed s1 is reached. Once the dwell speed s1 has been achieved, the processor is configured to signal the controller 88 such that the drum speed remains constant at speed s1 for a dwell duration d1. The dwell duration d1 can be determined based on the dwell speed s1 that is achieved, or based on inertia information such as rate of inertia change while the load is extracting water, or based on the wet to dry ratio which can be represented as the inertia of a wet load over the inertia of a dry load or some variation of such an equation, etc. At the completion of the dwell duration d1, the liquid extraction phase is completed. The lower plot illustrates the inertia of the laundry load over time. As time elapses in the spin cycle and water is removed from the laundry load, the inertia of the laundry load decreases. When the inertia gradient has been reduced to a predetermined point, the controller 88 can be configured to output a motor control signal to the motor 80 to begin dwell. It will be understood that on other circumstances, drum speed need not always increase at a steady rate, nor does dwell need always be at a steady speed.

During operation of the washing machine 10, the controller 88 can be configured to output a motor control signal to the motor 80 to rotate the drum 16. When the drum 16 with the laundry load mass rotates during a cycle of operation, the load mass within the interior of the drum 16 is a part of the inertia of the rotating system of the drum 16, along with other rotating components of the laundry treating appliance. By utilizing a parameter estimator, such as by estimation or calculation, the motor torque, acceleration of the drum 16, speed of the drum 16, and angular position of the drum 16, can be used to determine several parameters, including inertia and mechanical and viscous frictional forces. Sensors disposed within the laundry treating appliance can be utilized to determine motor torque, acceleration, speed, and position of the drum. Exemplary sensors include a motor torque sensor for determining torque and laser sensors or encoders to determine acceleration, speed, and position of the drum 16. Alternatively, the motor torque, acceleration, speed or position of the drum can be estimated from other measured signals such as currents and voltages.

By utilizing the parameter estimator, the inertia of the laundry load can be monitored in real time while the spin of the drum is ramping to a desired speed or as the spin of the drum is dwelling at a constant speed. As water is extracted from the laundry load, the inertia will decrease. The initial rate of change of the inertia values may be high as large quantities of liquid are rapidly leaving the drum 16. As the amount of liquid remaining in the laundry load decreases, the rate of change, or gradient, of the inertia will also decrease, which indicates that there is little value in continuing to spin the drum 16 at higher speeds. In low or medium absorbent load cases, where there may be minimal value in continuing to maximum spin speed because the RMC target has already been achieved at a lower speed, the controller 88 could send a signal to the motor 80 to discontinue the ramp and remain at the current speed for a pre-defined amount of time. In cases of very absorbent loads, reaching maximum speed could be beneficial in order to achieve the desired RMC. This is indicated when the inertia gradient continues to be sufficiently large to indicate that the load would benefit from continuing to higher speeds.

Using this information, an algorithm is created to adapt the final spin speed plateau using the real-time inertia measurements from the parameter estimator as the input signal for the algorithm. Thresholds could be set based upon the gradient of the inertia change, the absolute value of the inertia, a dry load inertia estimate, as well as a wet to dry ratio such as wet inertia/dry inertia, or any combination of them. When the inertia gradient has reached a threshold at which the change in inertia has become sufficiently small, or when the absolute value of the estimated wet load inertia is sufficiently close to the estimated dry load inertia, the controller 88 would send a signal to the motor 80 not to continue ramping beyond that speed. The threshold at which this action would occur is determined empirically based on experimental data received on a machine to machine basis. While the embodiment of this disclosure uses a parameter estimator to obtain the real-time inertia values, it is also contemplated that load cells could be used as an alternate method for load mass monitoring.

Figure 4:
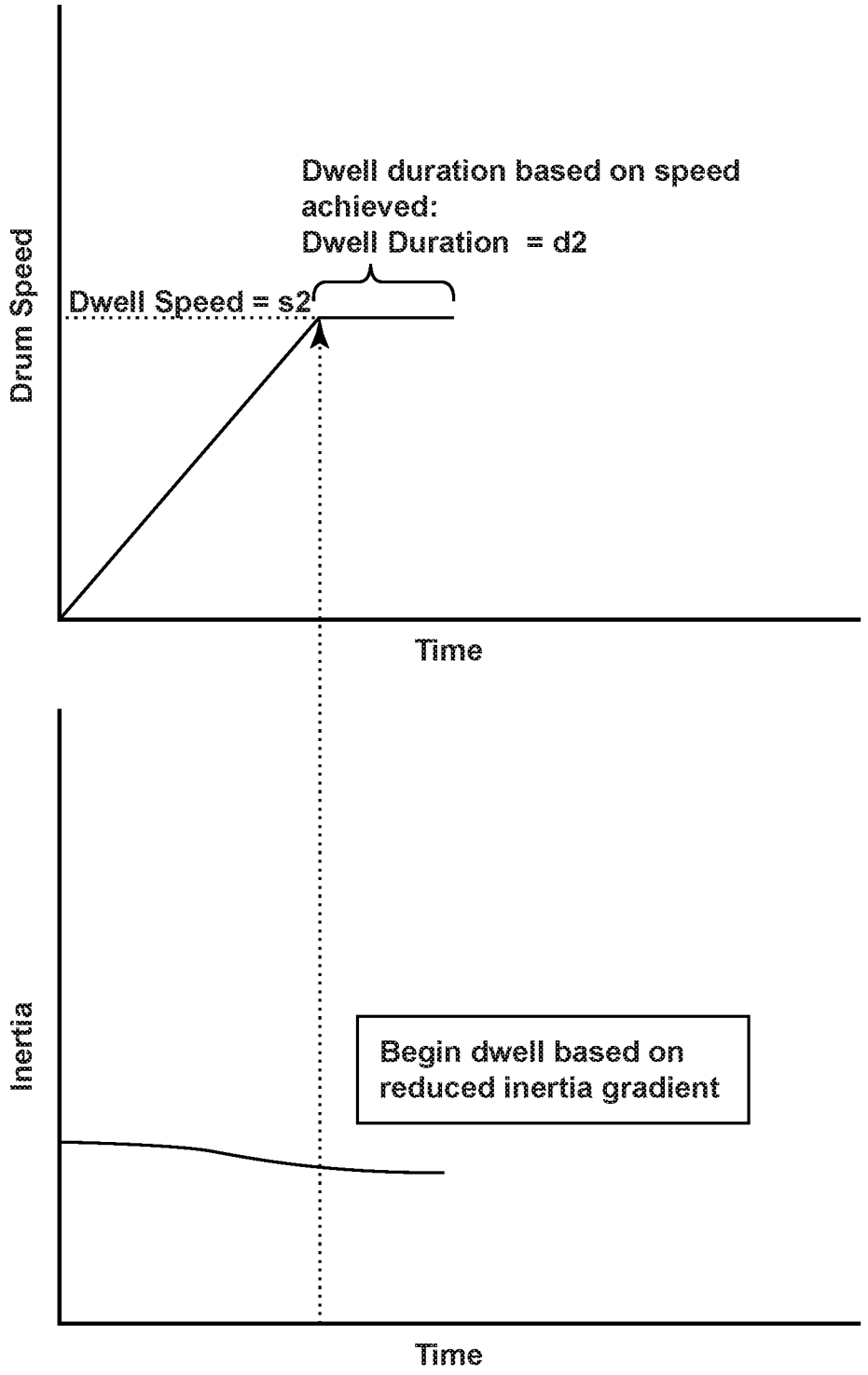
FIG. 4 is a series of two plots illustrating the rotational speed of a drum over time during a liquid extraction phase of a lower absorbent load than the load of FIG. 3 and the inertia of the drum over time during the same liquid extraction phase.

FIG. 4 illustrates the drum speed and inertia profiles of a laundry load of lower absorbency than the load portrayed by FIG. 3. The top plot of FIG. 4 shows that the drum speed ramps up, but reaches its dwell speed s2 at a lower spin speed than the load of FIG. 3. In addition, the dwell duration d2 of the laundry load of FIG. 4 is also shorter in length than that of the high absorbency load of FIG. 3. The lower plot of FIG. 4 shows that when the change in inertia begins to approach zero, as indicated by the vertical dotted line, the controller 88 determines that further ramping is not necessary and begins to dwell at the current speed s2.

The ideal duration of the dwell could be determined based on the plateau dwell speed that was achieved. For example, if the inertia values indicated that the load was nearly finished extracting water by 700 rpm, a relatively low spin speed, the algorithm could indicate that the machine should stop and dwell for a predefined time at 700 rpm (e.g. 60 seconds). Alternatively, if the inertia indicated that water was still being extracted at max speed (e.g. 1000 rpm), the algorithm could indicate that the machine should dwell at 1000 rpm for a pre-defined time period (e.g., 10 minutes), based on the inferred knowledge that the load still had water to extract. It is also contemplated that there could still be only a single pre-defined dwell duration time, and the only variable optimized by the algorithm would be the speed for the final dwell. However, by having dwell time as a function of dwell speed, there would be further optimization of cycle length.

Determine Angular Location of an Unbalance for Controlled Load Distribution

During operation of the washing machine 10, the controller 88 can be configured to output a motor control signal to the motor 80 to rotate the drum 16 to spin the drum to a maximum speed to force water out of the laundry load in a liquid extraction phase. When an unbalance of laundry items forms, spinning to high speeds can result in an increase of physical stresses to the washing machine system. As a result, it is advantageous to have a very well distributed load. This can require calculation of the satellization speed for a given load distribution in order to decide the speed at which to trigger deceleration of the drum 16 to move the unbalanced item 120. This technique may require several attempts to move the unbalanced item 120 when decelerating because when the drum 16 speed is reduced below satellization speed, the unbalanced item 120 may be located at the lowermost point of the drum 16. In this case, gravity will not be able to move the unbalanced item 120 to a new position. With multiple attempts, probability ensures the unbalanced item 120 is moved, but multiple tries may be required, adding to the total cycle time. In addition, items that were not previously unbalanced may be moved instead of or in addition to the unbalanced item 120. The object of the invention of this disclosure is to more effectively move only the unbalanced items 120 by taking advantage of the knowledge of the angular location of the unbalanced item 120 and intentionally time the deceleration of the drum 16 when the unbalanced item 120 is near the uppermost point of the drum 16, requiring fewer attempts to redistribute due to the intentional nature of the method.

Figure 5:
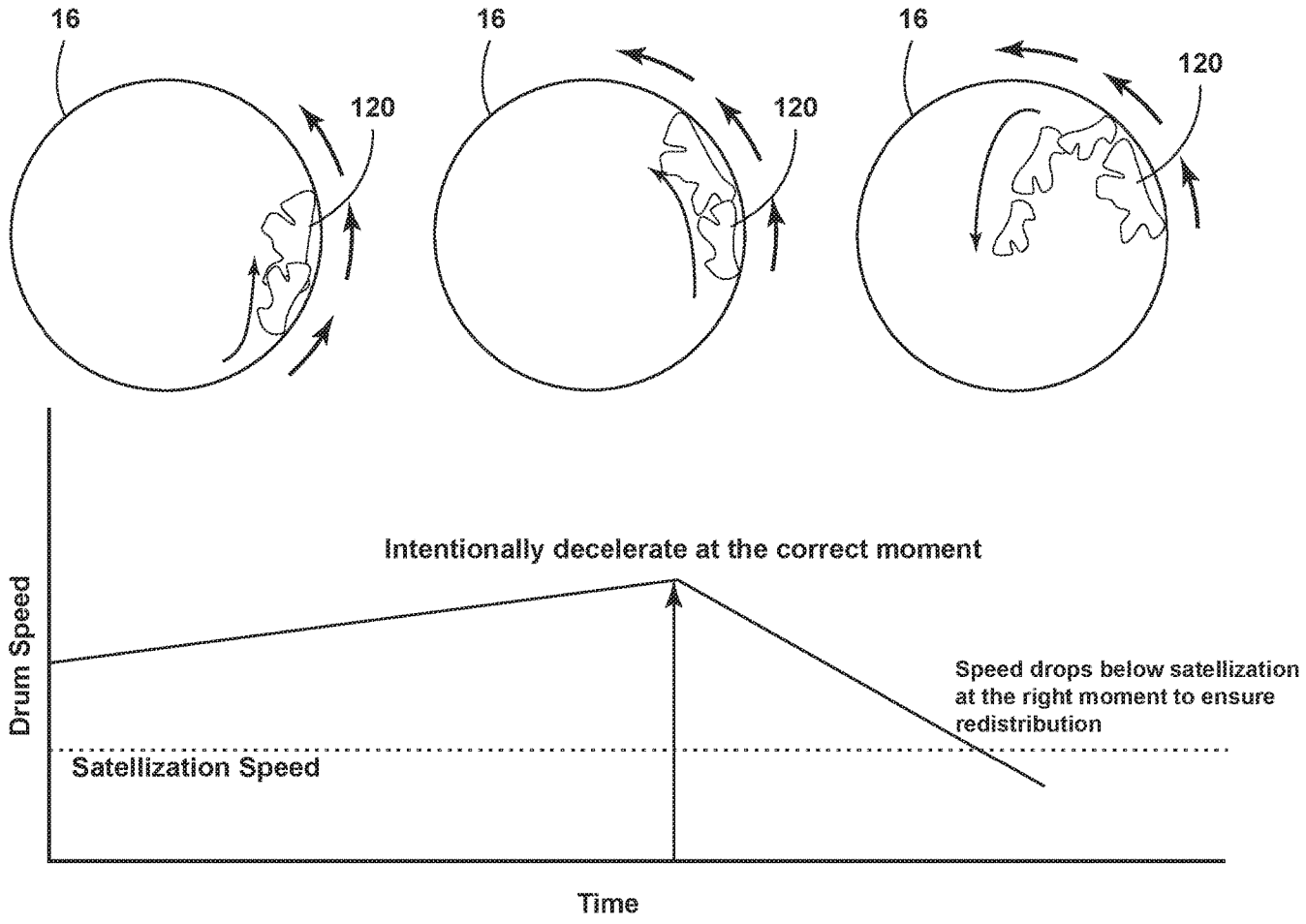
FIG. 5 is a schematic view illustrating a method of timing the deceleration of the drum such that the unbalanced item is at the uppermost point of the drum when drum speed drops below satellization speed.

FIG. 5 illustrates a method of timing the deceleration of the drum 16 in a horizontal axis laundry treating appliance such that the unbalanced item 120 approaches the uppermost point of the drum 16 when the speed of the drum 16 drops below satellization. By calculating, in real-time, the angular location of the unbalanced item 120, it is possible to know the correct moment at which to initiate deceleration of the drum 16 such that the unbalanced item 120 will move to a new location in the drum. Initiating deceleration of the drum 16 at the right moment ensures that the unbalanced item 120 will experience insufficient centripetal force to counteract gravity, rendering the unbalanced item 120 unable to remain satellized near the top of the drum, and therefore causing the unbalanced item 120 to fall within the drum. The movement of the unbalanced item 120 is therefore optimized while only minimally adjusting balanced items. Cycle time is also minimized due to fewer required attempts to move the unbalanced item 120 because the angular location of the unbalanced item 120 is known and can be moved intentionally.

An example of how real-time tracking of an unbalanced item 120 can be achieved is by utilizing a parameter estimator. By utilizing a parameter estimator, such as by estimation or calculation, the motor torque, acceleration of the drum 16, speed of the drum 16, and/or angular position of the drum 16, can be used to determine several parameters, including inertia, mechanical and viscous frictional forces, magnitude of a load imbalance, and position of a load imbalance relative to the position of the drum 16. Sensors disposed within the laundry treating appliance can be utilized to determine motor torque, acceleration, speed, and position of the drum. Exemplary sensors include a motor torque sensor or current and voltage sensors for determining torque, and laser or gyroscopic, or encoder sensors or current and voltage sensors to determine angular acceleration, speed, and position of the drum 16. Alternatively, torque, acceleration, speed, and position of the drum can be estimated from measured values such as current and voltage. Generally the relationship between motor torque for rotating the drum 16 and parameters relevant to the location of an unbalanced item 120 can be represented in equation (1), repeated here for convenience:

$$\tau = J\omega' + b*\omega + C + A*\sin(\alpha+\beta), \quad (1)$$

where, $\tau$=torque, J=inertia, $\omega'$=angular acceleration, $\omega$=angular speed, b=viscous friction, C=coulomb friction, A=amplitude of a basket speed first harmonic torque disturbance, which may be a function of the unbalance mass, surface tilt angle, gravitational acceleration, unbalance mass position, suspension asymmetries, basket speed, or other causes of conservative drag effects (i.e., rotational drag that depends on rotational position of the drum) $\alpha$=angular position of the rotating drum, and $\beta$=angular position of the effective unbalance relative to the rotating drum.

If this model (1) is used to represent the rotating system of a horizontal axis laundry treating device as described above, and a parameter estimator is designed such that the regressor contains the torque ($\tau$), the angular speed (w), the angular acceleration ($\omega'$), and the angular position of the rotating drum ($\alpha$), then the estimated values can include the angular position of the unbalanced item 120 relative to the rotating drum ($\beta$). By utilizing the knowledge of the position of the rotating drum ($\alpha$) and the knowledge of the effective unbalance position ($\beta$) in real time, the drum speed can be decelerated at the correct moment to ensure the unbalanced item 120 will be at an optimum angular location when the speed drops below satellization.

Utilizing a parameter estimator, multiple sensor measurements for one or more of the torque, acceleration, speed, or position of the drum 16 can be used to determine the angular location of the unbalanced item 120. The mathematical model of the washing machine 10, namely equation (1), describes the relationship between the magnitudes, position of the unbalanced item 120, and the torque, acceleration, speed and position. One is reminded that estimated electrical signals or motor signals can also be utilized as inputs including but not limited to, currents, voltages, etc. The characteristics of the inertia, the mechanical and viscous friction, and positions of the unbalanced item 120 can all be estimated parameters. Any suitable methodology or algorithm, proprietary or known, such as a recursive least squares algorithm can be used to estimate the parameters in the model. Thus, during operation, the controller 88, utilizing parameter estimation, can monitor over time outputs from the parameter estimator and generate one or more of a torque signal, a speed signal, an acceleration signal, or a position signal during the rotation of the drum 16. The controller 88 can also repeatedly determine or estimate the angular location of an unbalanced item 120, which can be done continuously or periodically. Such angular location can be repeatedly determined or estimated from the monitored outputs.

An additional form of difficulty may exist in a washing machine 10 with balance rings 30. Because balance rings 30 add to or subtract from the effective unbalance of the system, it would be easy for an algorithm as described above to confuse the position of the unbalanced item 120. In this case, an alternate model can be used which enables use of the above disclosed method in a machine with balance rings 30 using a balancer mass by allowing for the de-coupling of the unbalance generated by the balancer mass of the balance rings 30 from the unbalance generated by the load. When this is done correctly, the optimal instant to decelerate can be known as described herein. To accomplish this, the torque, speed, angular acceleration, and rotational position of the drum 16 can be utilized to determine the position of the reference axis, the magnitude of the balancer mass imbalance, and the position of the balancer mass. Generally the relationship between motor torque for rotating the drum 16 and parameters relevant to an off-balance laundry load can be represented in equation (2), repeated here for convenience:

$$\tau = J\dot{\omega} + b\omega + c + A\sin(\alpha+\beta) + B\sin(\alpha_{BB}+\beta_{BB}), \quad (2)$$

where, $\tau$=torque, J=inertia, $\dot{\omega}$=acceleration, $\omega$=rotational speed, b=viscous friction, c=coulomb friction, A=amplitude of a basket speed first harmonic torque disturbance, which may be a function of the unbalance mass, surface tilt angle, gravitational acceleration, unbalance mass position, suspension asymmetries, basket speed, or other causes of conservative drag effects (i.e., rotational drag that depends on rotational position of the drum), $\alpha$=rotational position of the drum, $\beta$=rotational position of the load imbalance mass relative to the rotational position of the drum, B=amplitude of a balancer disturbance, which may be a function of unbalance mass in the balancer, surface tilt angle, gravitational acceleration, unbalance mass position, basket speed, or other causes of conservative drag effects on the balancer mass, $\alpha_{BB}$=rotational position reference for the balancer mass relative to a fixed axis, and $\beta_{BB}$=rotational position of the center of mass of the balancer mass relative to the rotational reference position $\alpha_{BB}$. The parameter $\alpha_{BB}$ can be expressed as a tunable function of a such as $\alpha_{BB}=\alpha\cdot(k)$, for example, where the factor k can be tuned based upon exemplary conditions of the washing machine 10 such as the temperature, rotational speed, or balance ring physical characteristics. As such, a can be used determine to $\alpha_{BB}$ by utilizing sensors or a mathematical model operating within a controller.

Additionally, ($\alpha+\beta$) where a is the rotational position, plus fl, which is the imbalance phase angle, represents the rotational position of the load mass. ($\alpha_{BB}+\beta_{BB}$), where $\alpha_{BB}$ is the reference angle, plus $\beta_{BB}$, which is the balancer phase angle, represents the rotational position of the balance mass.

Furthermore, A can represent the magnitude of the moment generated by the imbalance of the load mass about an axis through the center point as determined by the mass, the radius of the load mass from the center point, and the gravitational acceleration acting on the load mass. Similarly, B can represent the magnitude of the moment generated by the imbalance of the balance mass about an axis through the center point.

Utilizing a parameter estimator, multiple sensor measurements for the torque, acceleration, speed, and position of the drum 16 can be used to determine the position and magnitude of the unbalance item 120 and the position and magnitude of the balancer mass. The mathematical model of the washing machine 10, namely equation (2), is used to describe the relationship between the magnitudes, position of the load mass and the balancer mass, and the torque, acceleration, speed and position. Further still, estimated electrical signals or motor signals can also be utilized as inputs including but not limited to, currents, voltages, etc.

The characteristics of the inertia, the mechanical and viscous friction, and magnitudes and positions of the unbalanced load mass and the balancer mass can all be estimated parameters. Any suitable methodology or algorithm, proprietary or known, such as a recursive least squares algorithm can be used to estimate the parameters in such a model.

Thus, during operation, the controller 88, utilizing parameter estimation, can monitor over time a torque signal, a speed signal, an acceleration signal, and a position signal during the rotation of the drum 16. The controller 88 can also repeatedly determine or estimate the position and magnitude of the load mass and the balancer mass, which can be done continuously or periodically. Such magnitude and position can be repeatedly determined and from the monitored values.

Figure 6:
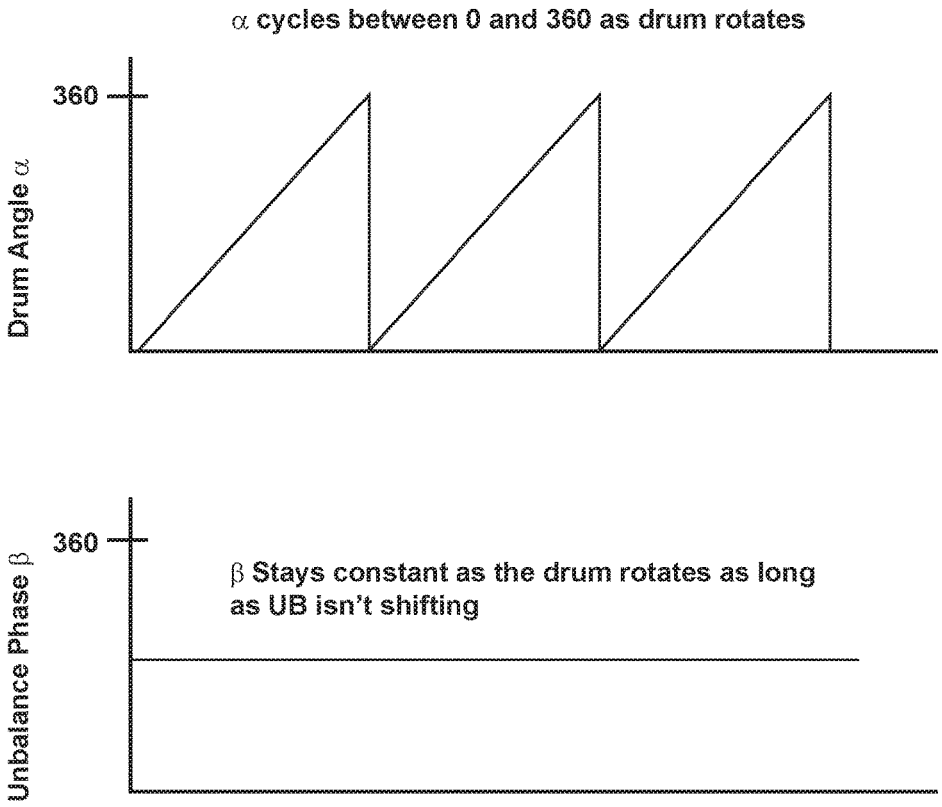
FIG. 6 is a set of two plots illustrating values of $\alpha$ and $\beta$ as the drum rotates.

The controller 88 can estimate current or predicted angular location of an unbalanced item 120 in order to determine when the ideal moment for deceleration of the drum 16 will occur. Turning now to FIG. 6, two plots illustrate the values of $\alpha$ and $\beta$ as the drum 16 rotates. While the drum is rotating, the drum angle $\alpha$ will cycle between 0 degrees and 360 degrees. The unbalance phase $\beta$ will be a nearly constant value as long as the unbalance (UB on plot) item 120 is not shifting in space relative to the drum, which generally only occurs after satellization.

Figure 7:
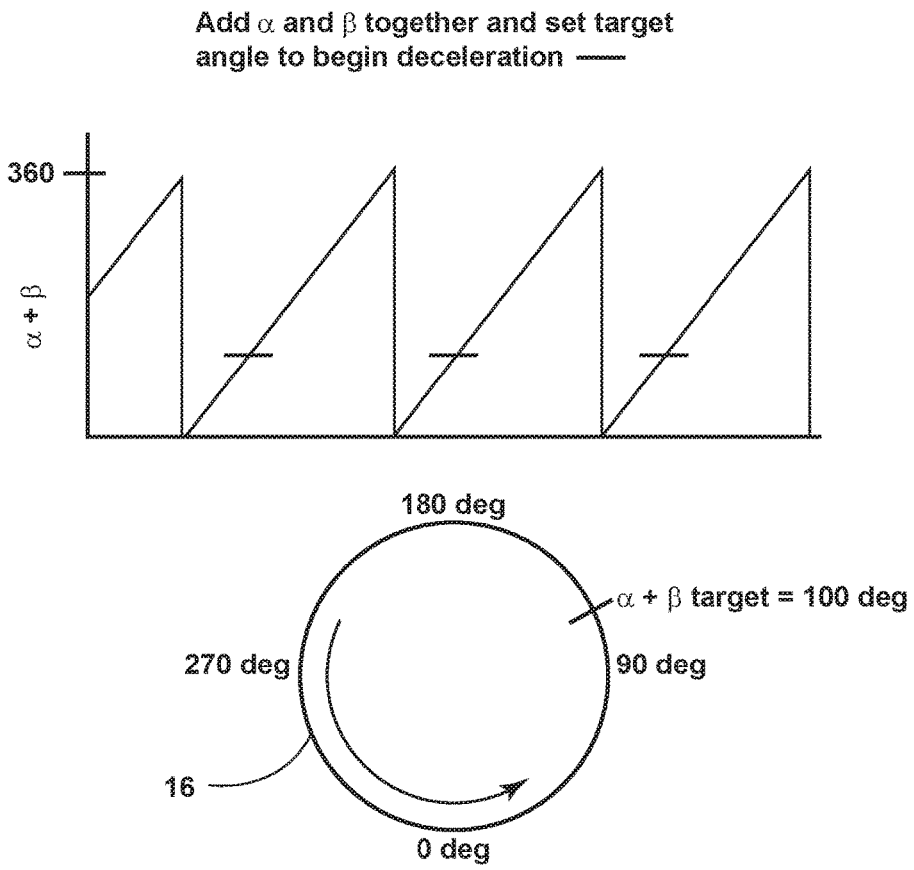
FIG. 7 is a plot illustrating the addition of $\alpha$ and $\beta$ to set a target angle at which to begin deceleration.

FIG. 7 illustrates that by adding together $\beta$ and $\alpha$, a reference point is gained by which to track the position of the unbalance item 120 as the drum 16 rotates. Because the unbalance generates a torque peak when the unbalance is being lifted up the side of the drum 16 (at 90 degrees), the value of $\beta+\alpha$ will correspond to the angle of the net unbalance location as it moves rotationally, where 0 degrees=the bottom of the drum 16 and 180 degrees=the top of the drum 16, assuming a vertical gravity vector. Therefore, $\beta+\alpha$ can be monitored against an angle value threshold to control when to decelerate the drum 16. For example, a good angle value threshold at which to begin decelerating could be 100 degrees.

Figure 8:
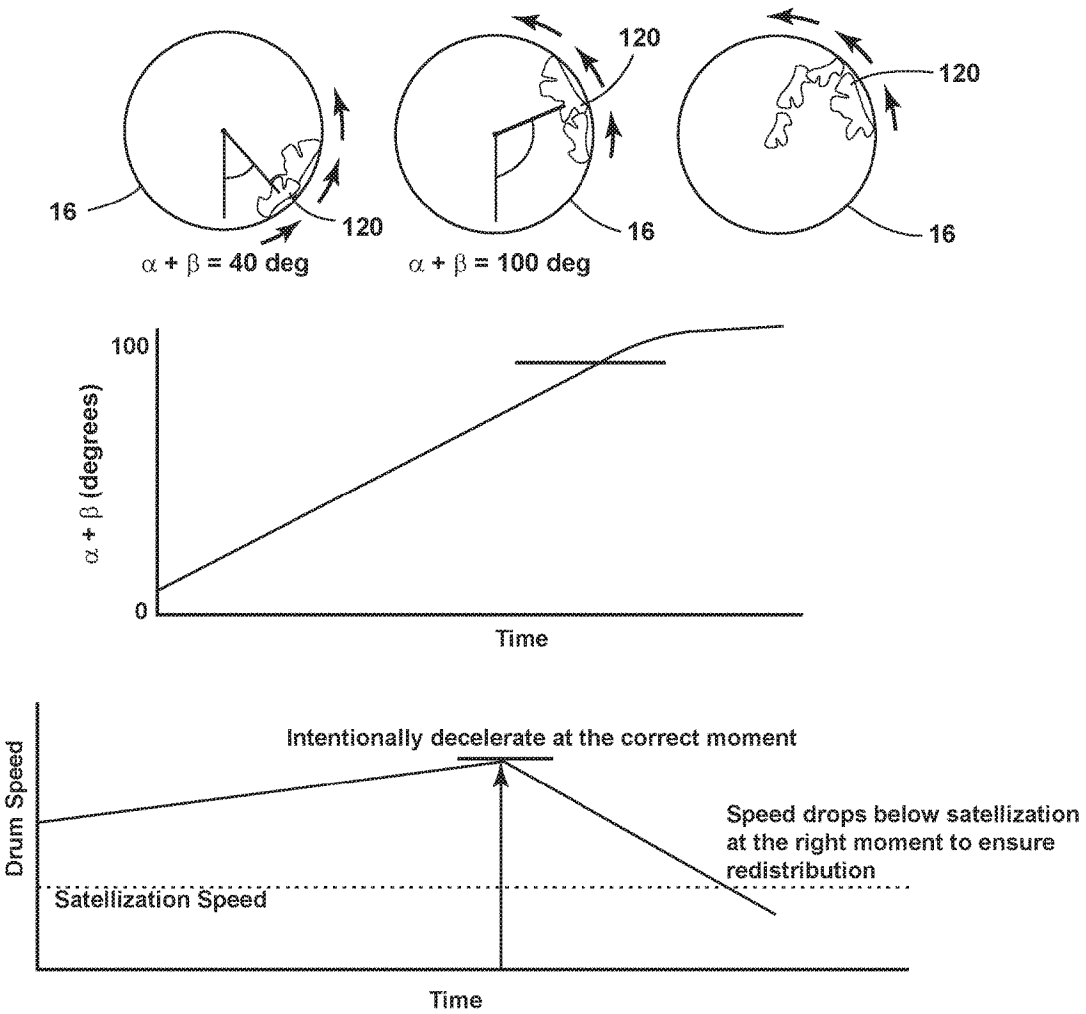
FIG. 8 is a series of plots illustrating correlation and coordination of the angular position of an unbalance item, the value of $\beta+\alpha$, and the drum speed progression through the initiation of deceleration of the drum.

FIG. 8 illustrates the correlation and coordination of the angular position of the unbalance item 120 in the drum 16, the value of $\beta+\alpha$, and the drum speed progression prior to and after initiation of deceleration of the drum 16. By beginning deceleration of the drum 16 at the angle threshold of 100 degrees as determined in the example of FIG. 7, it is ensured that by the moment the unbalance item 120 reaches 180 degrees (the topmost point of the drum 16), the drum speed has dropped below satellization and is therefore in an ideal scenario to be repositioned such that gravity will move the item because the drum speed is less than the satellization speed. Note that this is merely one example of an optimal condition to move the item(s). Other optimal angles may exist other than 180 degrees, depending on the objective of how to distribute the load.

In another embodiment of the invention, using parameter estimation, the control may decelerate the drum in response to the magnitude of the load imbalance moment irrespective of the load imbalance position. Current methods of estimating load imbalance magnitude utilize the combined, or effective, imbalance comprising the superposition of the load imbalance with the balancer mass imbalance. This causes difficulty in accurately estimating the load imbalance magnitude, because the balancer mass imbalance can be at various instants adding to, or subtracting from the load imbalance. This approach is exemplified in the case where equation (1) is applied to a machine with a balance ring. In this case, the imbalance moment A represents a combined moment of the load imbalance and balancer mass imbalance.

Referring to equation (2), the inclusion of the balancer term B $\sin(\alpha_{BB}+\beta_{BB})$ in the model of the washer allows for the decoupling of imbalance effects into those caused by the load, and those caused by the balancer mass. When using equation (2), the load imbalance moment A represents only the contribution of the load to the overall imbalance of the washer. This decoupling provides a significant improvement over current methods in the accuracy and resolution of the load imbalance magnitude estimate. This load imbalance magnitude is more useful than the effective, or combined, imbalance magnitude in deciding whether to redistribute the load. Thus, the control may use the load imbalance magnitude and/or the load imbalance position when determining whether and at which instant to decelerate the drum to redistribute the load.

Detection of Critical Drag Events Using Real-Time Friction Estimation

During operation of the washing machine 10, the controller 88 can be configured to output a motor control signal to the motor 80 to rotate the drum 16 to spin the drum to a maximum speed during a liquid extraction phase. As the washing machine 10 operates in the extraction phase, it is advantageous to achieve high spin speeds so as to optimize the amount of acceleration the load experiences, and therefore maximize the amount of water that leaves the clothes as a result of this acceleration. Certain undesirable conditions can occur during this phase that impede the ability of the washing machine 10 to achieve maximum speeds in a desirable way, such as friction-related events that add drag to the system. Non-limiting examples of such events include water swirl induced events also known as water ring events, stuck clothing items, and excessive suds, also known as suds lock.

In the water ring condition, significant water build up occurs between the tub 14 and the drum 16 during extraction because the rate of extraction may exceed the system's ability to purge the water, and/or because of physical limitations of the space between the tub and drum. For example, at high speeds, the water motion may become coupled with the basket rotation and the excessive water may start swirling with the basket. This action may add excessive drag to the system, requiring higher than normal energy in order to spin the drum 16, which may prevent maximum spin speeds from being achievable. In order to address the water ring event, drum speed must be reduced to stop the swirling motion so that the drain pump can actuate on the excessive water and allow the water to be released from the tub. In the suds lock condition, which may be caused by adding too much detergent into the washer, excessive suds add drag that the motor 80 must overcome to achieve higher spin speeds and impede the effectiveness of the extraction phase. To correct the condition, drum speed can be lowered and water added to the basket and the tub to allow the suds to break up. Correcting this condition adds to the cycle time of the washing machine 10. When the condition goes uncorrected, clothes can remain soapy at the end of the cycle. When a stuck clothing condition occurs, clothing items can become caught between a rotating part of the system and a stationary part. When this occurs, the drag of the system increases and more power is required to spin the drum to high speeds.

The invention of this disclosure allows for drag events to be detected using continuous, real-time monitoring of estimated values, eliminating the need for multiple dwells to identify drag events and enabling the washing machine 10 to identify drag events even during ramping. And once a drag event is determined to have occurred, the controller 88 can send an appropriate signal in response, such as but not limited to a notification to a user, a motor signal to alter the speed or acceleration of the motor, and/or a cessation of a cycle of operation, etc.

An example of how real-time monitoring for the detection of drag events can be achieved is by utilizing a parameter estimator to continuously monitor estimated values, such as coulomb friction or viscous friction. By utilizing a parameter estimator, such as by estimation or calculation, the motor torque, acceleration of the drum 16, and speed of the drum 16 can be used to determine several parameters, including inertia, mechanical and viscous frictional forces, coulomb friction losses, and indication of the occurrence of high drag events. Sensors disposed within the laundry treating appliance can be utilized to determine one or more of motor torque, acceleration, speed, or position of the drum. Exemplary sensors include a motor torque sensor or current and voltage sensors for determining torque, and laser or gyroscopic or encoder sensors or current and voltage sensors to determine angular acceleration, speed, and position of the drum 16. As discussed previously, measurements can be done with an observer using voltage, current, and/or speed sensors. Generally the relationship between motor torque for rotating the drum 16 and parameters relevant to the occurrence of a high drag event can be represented in equation (1), repeated here for convenience:

$$\tau = J\omega' + b*\omega + C + A*\sin(\alpha+\beta) \quad (1)$$

where, $\tau$=torque, J=inertia, $\omega'$=angular acceleration, $\omega$=angular speed, b=viscous friction, C=coulomb friction, A=amplitude of a basket speed first harmonic torque disturbance, which may be a function of the unbalance mass, surface tilt angle, gravitational acceleration, unbalance mass position, suspension asymmetries, basket speed, or other causes of conservative drag effects (i.e., rotational drag that depends on rotational position of the drum) $\alpha$=angular position of the rotating drum, and $\beta$=angular position of the effective unbalance relative to the rotating drum. Additionally, Total Friction=$b*\omega+C$.

Utilizing a parameter estimator, multiple sensor, and/or estimated measurements for one or more of the torque, acceleration, speed, or friction can be used to determine the occurrence of a high drag event. The mathematical model of the washing machine 10, namely equation (1), describes a relationship between estimated and measured parameters. The characteristics of inertia, the mechanical and viscous friction, and the occurrence of a drag event can all be estimated parameters. Any suitable methodology or algorithm, proprietary or known, such as a recursive least squares algorithm can be used to estimate the parameters in such a model. Thus, during operation, the controller 88, utilizing parameter estimation, can be configured to monitor outputs over time, and estimate viscous and coulomb friction, or a rate of change of friction, or a friction difference between two or multiple different instants during the cycle, during the rotation of the drum 16. The controller 88 can also repeatedly determine or estimate the total friction, which can be done continuously or periodically. Such total friction, as an indicator of the occurrence of a high drag event, can be repeatedly determined from the monitored values. Such total friction can be used for repeatedly obtaining a friction differential relative to a baseline speed, or to obtain a friction difference between two speed points in the cycle.

Figure 9:
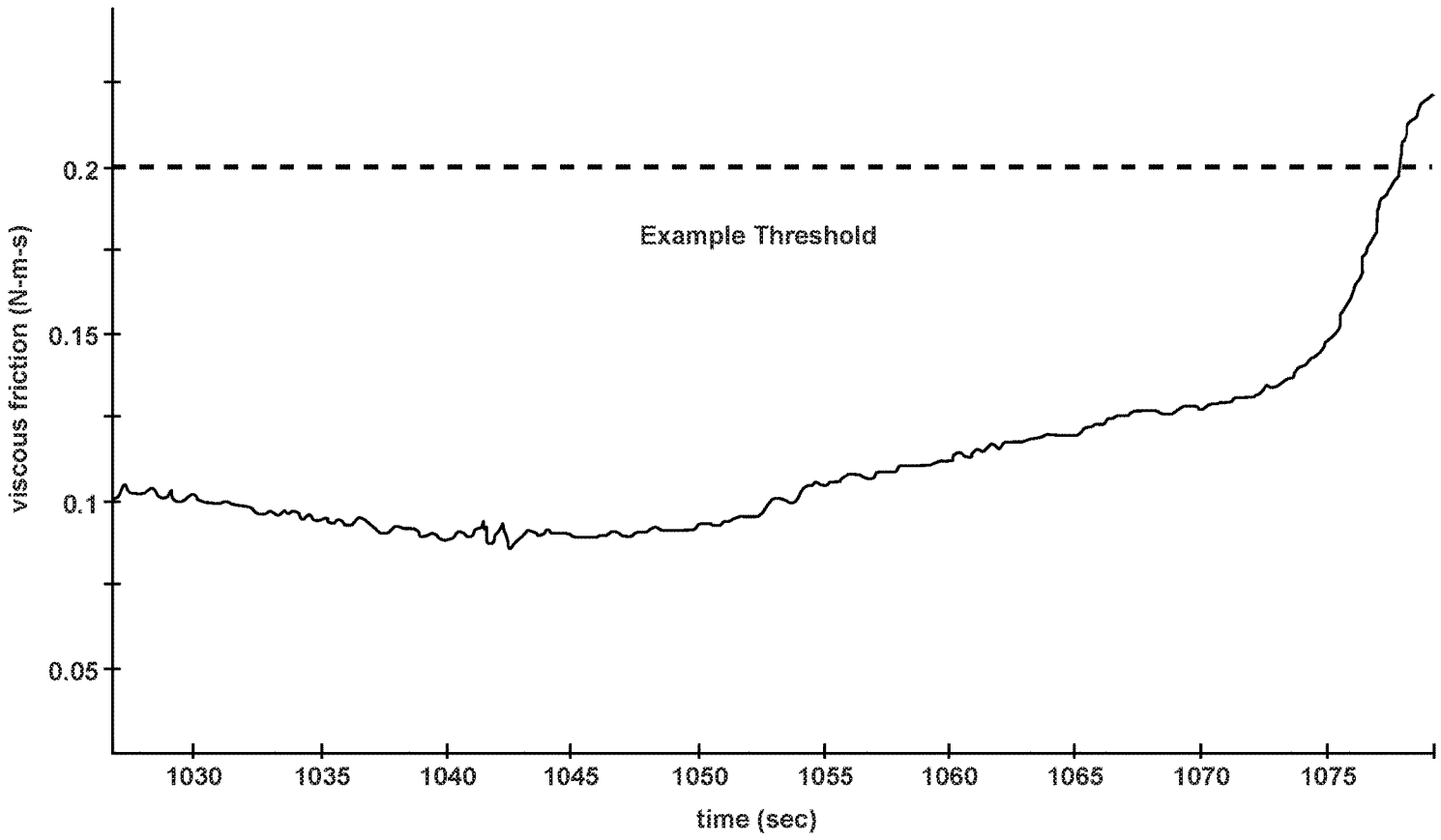
FIG. 9 is a plot illustrating a method of detecting drag events by continuously monitoring viscous friction for excessively large values.

The controller 88 can continuously estimate various forms of friction, as well as inertia, in order to detect critical friction or drag events, which can be done in a variety of ways. FIG. 9 illustrates a method of detecting drag events by continuously monitoring the viscous friction for excessively large values. Because viscous friction is the slope of the total friction, the viscous friction values respond quickly to changes in total friction. Monitoring change in viscous friction values can be valuable for detecting quickly occurring drag or friction events. An example friction threshold is illustrated for determining at what point change in the viscous friction values are indicative of an undesirable event. This threshold, which could also be a friction rate change or a friction difference threshold, would be established empirically or experimentally by machine type.

Figure 10:
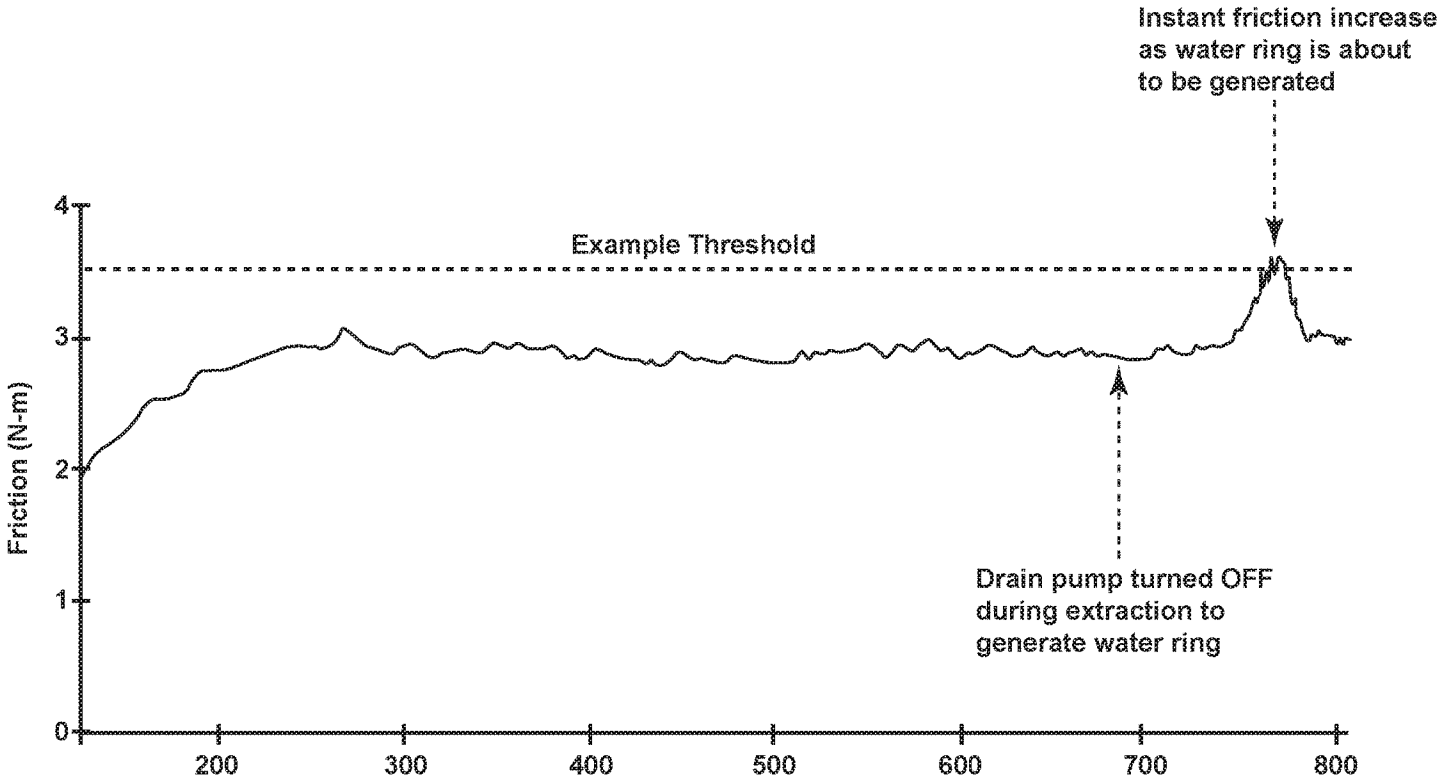
FIG. 10 is a plot illustrating how total friction can be monitored to detect dramatic changes in friction that appear quickly.

FIG. 10 illustrates how total friction can also be used to detect dramatic changes in the friction that appear quickly, similar to the continuous monitoring of viscous friction illustrated in FIG. 9. In the example illustrated by the plot of FIG. 10, the drain pump of the washing machine 10 was intentionally turned off, in order to create a water buildup. If the pump were left off for a longer period, the water buildup would result in a forced water ring condition. The sudden peak in the total friction signal rendered the water ring condition easily predictable. In this case, since the rate of change of the total friction is large, the method of monitoring viscous friction would also easily predict this condition.

Figure 11:
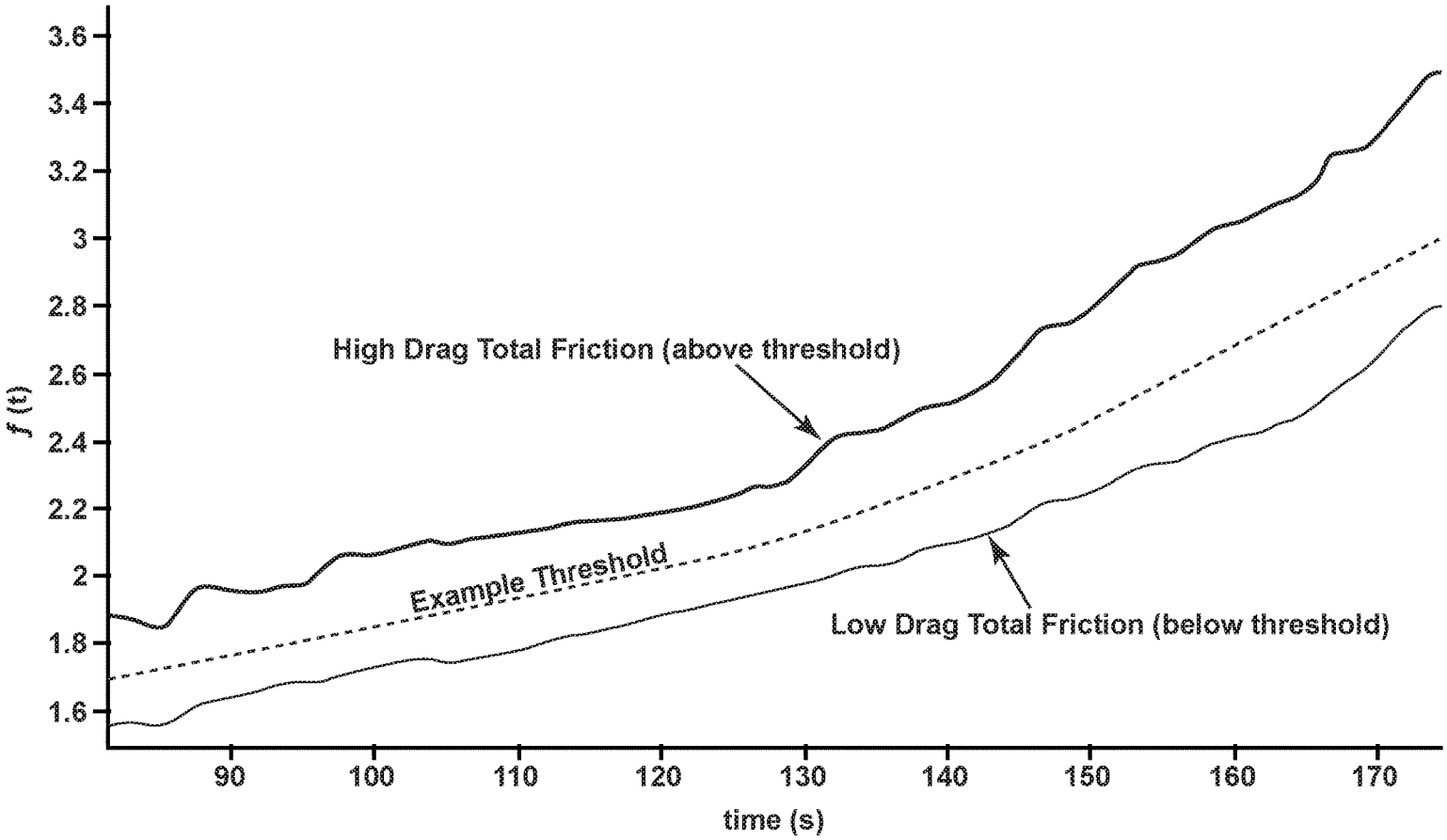
FIG. 11 is a plot illustrating total friction over time that can be used with a high threshold limit to detect events that cause a general change in drag.

FIG. 11 illustrates a plot of total friction over time that can be used with a high friction threshold limit to detect things like trapped items that may cause a general change in drag. For example, the total friction can be shifted up from what is typical for a load at a given speed. This shift could be a coulomb friction shift or a combination of viscous and coulomb friction shift. In the total friction detection case illustrated herein, the friction threshold can be a function of speed such that the friction changes due to the increase in drum speed are automatically compensated for.

An Algorithm for Cycle Optimization Based on Water Extraction Monitoring Through Repeated Estimation of Load Moment of Inertia As the washing machine 10 operates in the extraction phase, the water held by the clothes start to be extracted out of the clothes due to large centripetal acceleration of the clothes, driven by the rotational motion of the basket. The extraction rate is driven by multiple factors, some of which are known, and some of which are unknown. For example, target basket speed during the extraction phase, or the basket geometry associated with a specific washing machine are known washer characteristics that directly affect the water extraction rate due to their contribution to the centripetal acceleration. On the other hand, unknown factors contributing to the water extraction rate may include dry load mass of the clothes load, distribution of the clothes load inside the basket, and fabric type and water absorption/extraction characteristics of each clothes item inside the basket. Since these unknown factors vary significantly in each cycle, prediction or estimation of water extraction behavior during a cycle cannot be accurately achieved by the use known washer characteristics only.

Therefore, water extraction behavior can be difficult to detect due to the unknown cycle-to-cycle changes in the factors that contribute to water extraction characteristics. However, it is useful to predict, or estimate water extraction profile of the clothes load prior to, or during the final extraction spin. If a prediction or estimation of the water extraction profile can be achieved, then this information can be used to optimize each cycle by modifying the speed profile for the final extraction spin. This modification can lead to key performance enhancements in areas such as energy consumption, remaining moisture content (RMC), cycle time and reliability. For example, if an algorithm could predict a fast water extraction rate during the final extraction spin, then the rotational acceleration of the final extraction spin could be commanded to a lower value, which would avoid large quantity of water build-up in the tub, leading to smaller water drag and therefore less energy consumption as well as smaller motor torque and therefore a smaller increase in the motor temperature during the ramp to the final speed. As another example, if the quantity of remaining water on the clothes before the final extraction spin is estimated to be small, the final spin speed or the spin duration of the final extraction spin could be lowered to reduce energy consumption and cycle time. The invention of this disclosure utilizes the estimated values of the load inertia taken at various instances during the entire cycle obtained by the use of a parameter estimator, which can be used to predict the water extraction rate during the final extraction spin, or estimate quantity of water to be extracted during the final extraction spin. An example of how real-time monitoring for the prediction and estimation of water extraction behavior can be achieved is by utilizing a parameter estimator to continuously monitor estimated values of load moment of inertia. By utilizing a parameter estimator, such as by estimation or calculation, the motor torque, acceleration of the drum 16, and speed of the drum 16 can be used to determine several parameters, including clothes load inertia, and indication of the quantity of predicted water extraction rate and estimated quantity of water remaining on the clothes.

Figure 12:
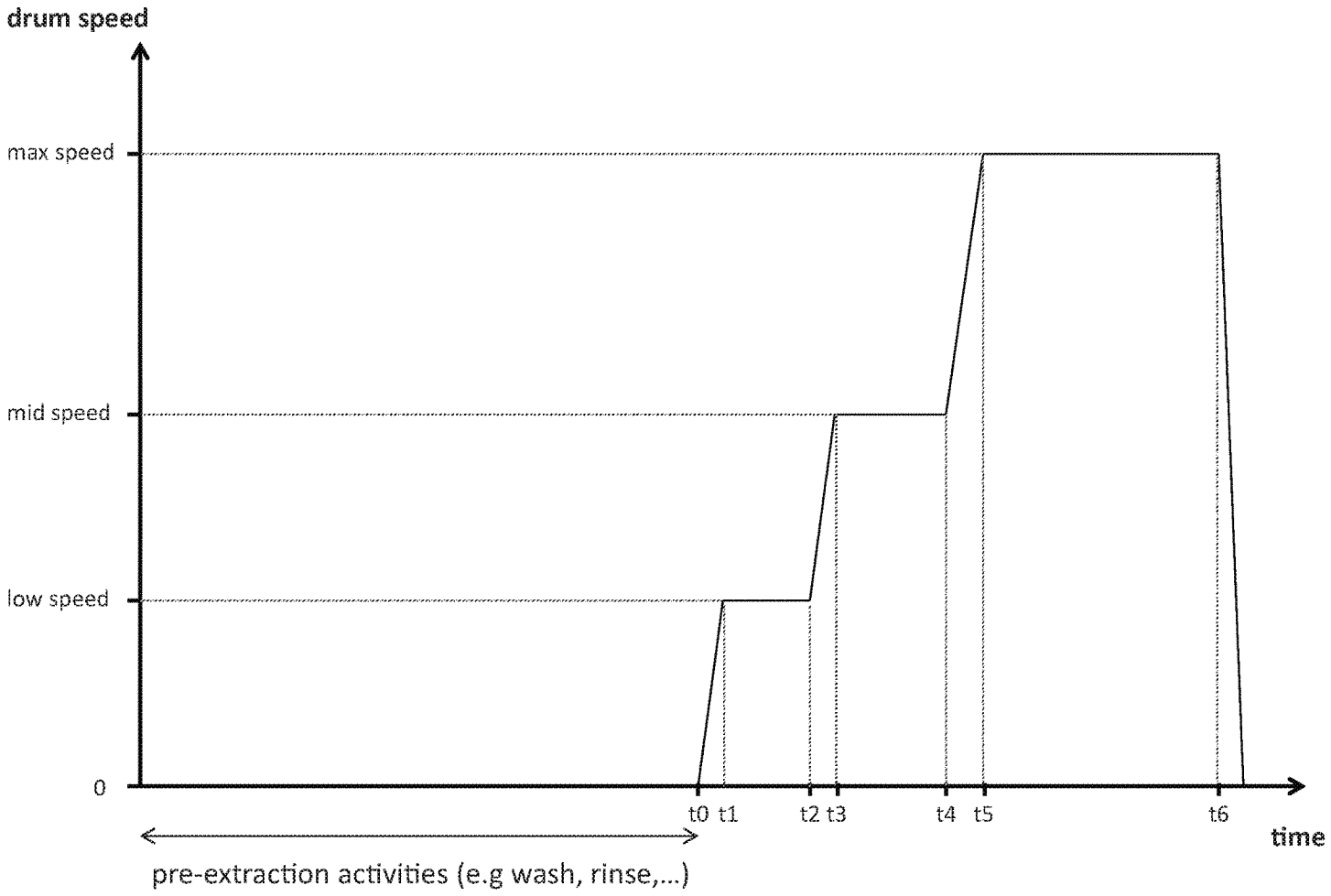
FIG. 12 is a plot illustrating a profile of drum speed and water level during a normal cycle.

FIG. 12 illustrates a hypothetical profile of drum speed during a normal operation cycle. In this example, the extraction phase starts at the t0 time point on the x-axis. At any time point after t0 until the end of the cycle, that is, until t6 in the figure, a real-time parameter estimation algorithm, including but not limited to recursive least squares, can be activated to obtain continuous estimates of load moment of inertia during the extraction phase. The water extraction profile of the clothes load, including the water extraction rate, and quantity of water remaining on the clothes, can be determined through an estimation or a prediction scheme that may involve an algebraic calculation, or a look-up table, utilizing the load moment of inertia values provided by the parameter estimation algorithm prior to achieving the maximum spin speed. Depending on the predicted water extraction rate at the final ramp (ramp from t4 to t5), at least one of the ramp rate, final spin speed, or duration of the dwell at the final spin speed (that is, t6–t5) could be adjusted. Similarly, at least one of the ramp rate, final spin speed, or duration of the final speed dwell can be adjusted based on the estimated amount of water still held by the clothes load.

When the drum 16 with the laundry load mass rotates during a cycle of operation, the load mass within the interior of the drum 16 is a part of the inertia of the rotating system of the drum 16, along with other rotating components of the washing machine 10. By utilizing a parameter estimator, such as by estimation or calculation, the load inertia taken at various instances during the extraction cycle, and using the recursive least squares parameter estimation algorithm, can be used to provide a prediction of the water extraction rate, or an estimate of the remaining water mass in the clothes (load). Generally, a quadratic equation that involves past load inertia values can be used for obtaining these quantities The past inertia values include the moment of inertia of the empty basket, denoted by J0, the moment of inertia of the load when the clothes are dry, denoted by $J_{dry}$, and the moment of inertia of the load when the clothes are wet, at different time points during the extraction cycle.

More specifically, J0 is the moment of inertia of the basket when it is completely empty, and $J_{dryload}$ is the moment of inertia of the basket filled with a dry clothes load in the beginning of the cycle. It will be assumed here that the quantities of J0 and $J_{dry}$ are known. The J0 value can be obtained by the knowledge of the physics and geometry of the basket of the washing machine, or through a factory calibration algorithm. $J_{dry}$ can be obtained by a dry load sensing algorithm at the beginning of the cycle. Additional inputs to this algorithm may include multiple moment of inertia values of the load at different time points during the extraction cycle when the clothes are wet. For example, one input could consist of a wet load inertia value at a low speed, denoted by $J_{low}$, that is estimated during a low speed portion in the beginning of the extraction phase. This low speed inertia estimation could take place, for example, at 50 rpm, 100 rpm, or at another similar speed range. Another input could consist of a wet load inertia value at a mid speed, denoted by $J_{mid}$, that is estimated during a mid speed portion of the extraction phase. This mid speed inertia estimation could take place, for example, at 300 rpm, 500 rpm, or at another similar speed range. $J_{low}$ and $J_{mid}$ estimation can take place during a ramp or a dwell, through a parameter estimation algorithm including but not limited to a recursive least squares method. It is contemplated that the water extraction estimation algorithm can be lookup-table-based or formula-based. In the formula-based approach of this disclosure, these moment of inertia values are used as inputs in order to provide a prediction for the water extraction rate or an estimation of the water mass held by the clothes load as the outputs.

Using these inertia inputs, two critical intermediate variables of the algorithm (W2D, LTR) can be obtained. In order to obtain these variables, we first define dry clothes load inertia $J_{dryload}$ by the following equation:

$$I_{dryload}=J_{dry}-J0. \tag{3}$$

Then, W2D is defined by the following equation:

$$W2D=(J_{mid}-J0)/J_{dryload}, \tag{4}$$

And LTR is defined by the following equation:

$$LTR=(J_{low}-J_{mid})/J_{dryload}. \tag{5}$$

W2D, the ratio of the wet load inertia to the dry load inertia, is important for the estimation of the remaining water mass held by the clothes load. Intuitively, if W2D is significantly larger than 1, then the amount of water mass still held by the clothes load is large and therefore it is expected that the clothes may extract large amounts of water at a higher spin speed. Conversely, if the W2D value is closer to 1, then the clothes have already extracted most of the water and will no longer extract large sums of water even if the drum 10 spins to a higher speed.

On the other hand, LTR is a ratio of the extracted water mass amount to the dry load mass of the clothes, which gives an indication of the absorbency and extraction characteristics of the clothes load. For example, suppose that $J_{Low}$ and $J_{Mid}$ estimates have been calculated at times t2 and t4 in FIG. 12. Then, if LTR is large, this means that the clothes have extracted large amount of water mass relative to the dry load mass, from time t2 to t4. This may indicate that the majority of the clothes load in the drum 10 are made of high absorbency fabric type, and may indicate a prediction of fast water extraction rate during the ramp to the final speed. Alternatively, if the LTR value is small, then this means that the clothes have not extracted significant amount of water from t2 to t4 relative to the dry load mass. Assuming that the mid speed where $J_{Mid}$ is estimated is sufficiently faster than the low speed where $J_{Low}$ is estimated, this may indicate a that the majority of the clothes load in the drum 10 are made of low absorbency fabric type, and may indicate a prediction of slow water extraction rate during the ramp to the final speed.

W2D can be used to make adjustments on the speed profile on the final spin portion, that is, the portion of the cycle at FIG. 12 between times t4 and t6. For example, if the obtained W2D value is small, then the final spin speed can be adjusted to be a smaller speed compared to the max speed. Alternatively, the duration of the dwell at the final speed (t6–t5) can be shortened to reduce cycle time. Conversely, if the W2D value is large, then the final spin speed should be significantly larger compared to mid speed in order to force extraction of the remaining water mass from the clothes. In this case, unless there are other constraints on the final spin speed, the final speed target can be adjusted to be the max speed.

Similarly, LTR can be used to make adjustments on the speed profile on the final spin portion. For example, if the estimated LTR value is large, then the rotational acceleration during the ramp between t4 and t5 can be adjusted to be smaller to minimize the likelihood of a water buildup in the tub. A large LTR could also be used to increase the target final spin speed or the final spin duration to allow more water extraction. Similarly, small LTR could be used to adjust the acceleration to be faster than nominal, as the expected water buildup during the ramp is minimal. Small LTR could also be used to decrease the target final spin speed or the final spin duration.

Figure 13:
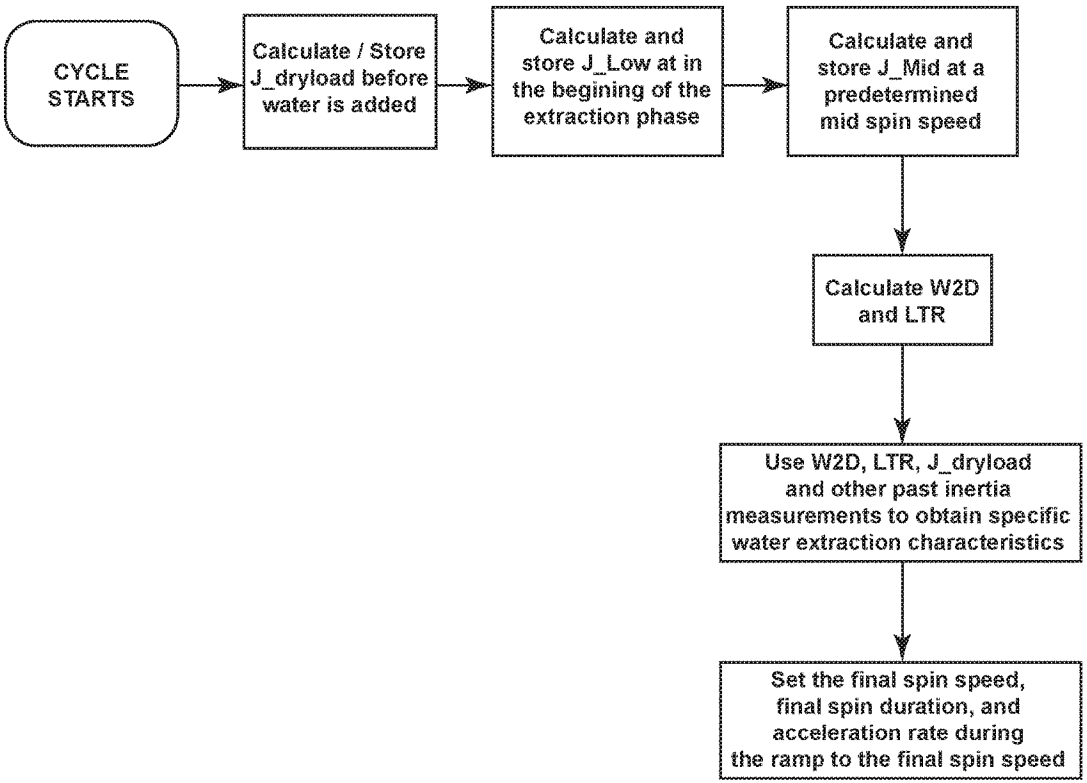
FIG. 13 is a decision chart illustrating the steps and decision-making criteria of the algorithm.

Finally, LTR and W2D values could be combined with other inertia estimates obtained during the extraction phase as well as with dry load inertia value in a linear, quadratic or a polynomial fit model. The coefficients of the specified fit model can be tuned empirically for a specific washer architecture to output a specific water extraction characteristic. For example, W2D and LTR could be combined with dry load inertia and wet load inertia measurements taken at multiple points during the extraction cycle to determine one or more of the water extraction characteristics such as total extracted water mass, total remaining water mass in the drum, average extraction rate between low-speed and mid-speed, or expected value of water extraction rate per time during the ramp to the final spin speed. The same characteristics of the final spin speed profile, such as spin duration, spin speed, and acceleration during the ramp may be adjusted based on the combined estimates of W2D, LTR, dry load inertia and multiple wet load inertia values FIG. 13 illustrates a decision chart of the steps and the decision-making criteria of the algorithm. The sequence depicted is for illustrative purposes only, and is not meant to limit the determination in any way, as it is understood that the determination can proceed in a different logical order or additional or intervening steps can be included without detracting from the invention. The determination can be implemented in any suitable manner, such as automatically or manually, as a stand-alone phase or cycle of operation or as a phase of an operation cycle of the washing machine 10. At the beginning of the cycle, $J_{dryload}$ is calculated and stored. In the beginning of the extraction phase, $J_{low}$ is calculated and stored. At an intermediate speed during the extraction phase, $J_{mid}$ is calculated and stored. Additional inertia measurements can be calculated and stored during the extraction phase. Once these numbers have been obtained, W2D and LTR are calculated, which are then used to calculate the several water extraction metrics. Based on these metrics, the washer can proceed to the final spin with no constraints on the maximum spin speed, or the final spin can be adjusted by adjusting the acceleration rate, the final spin speed, or duration of the final spin.

A Covariance Resetting Strategy for Washer Parameter Estimation in the Presence of Drag Fluctuations Due to Switching of a Drag-Inducing Machine Component In washing machines, estimation of key machine parameters such as load inertia, load unbalance, viscous drag and coulomb drag can be challenging when one or more of the machine components undergoes a switch in its mode of operation. The challenge arises when this switching operation causes a sudden and drastic change in the rotational drag opposing the motion of the drum 10.

The washing machine has a variety of components whose operation can be switched on or off. However the focus of this disclosure addresses those components that can induce a change in the rotational drag opposing the drum 10 when they are switched on or off. These components include pumps such as a drain pump or a recirculation pump, water valves, nozzles, inlets, conduits, dispensers, and finally, the relays in the electrical board that are used to activate/deactivate these components. For example, turning on a water valve and activating a spray nozzle to spray water on the drum 10 during a rotational motion will result in a sudden increase in the rotational drag that opposes the motor. Similarly, switching the valve off will stop the spray action and therefore will result in a sudden decrease in the rotational drag. As another example, consider the operation of the drain pump 64, and suppose that the sump 60 is filled with water such that the water level is high enough to contact the drum 10. Such a high water level in practice could occur if the drum 10 is filled with loads that have a fast extraction rate. In this case, activating the drain pump will cause an abrupt reduction in the viscous drag due to the removal of the water. Thus, by the nature of their operation modes, some machine components as listed above can, when turned on or off, induce sudden and significant fluctuations in the rotational drag, and therefore the torque that the motor has to apply to maintain a speed and acceleration profile. Since the parameter estimation algorithm uses the measurements of torque to determine the system parameters, on/off operation of these components adds noise to the inertia estimation as well as estimation of other parameters in the washer model (equation 1). The disclosure herein provides for a covariance resetting strategy in order to improve the accuracy of parameter estimation for estimating inertia, friction, and unbalance mass.

Figure 14:
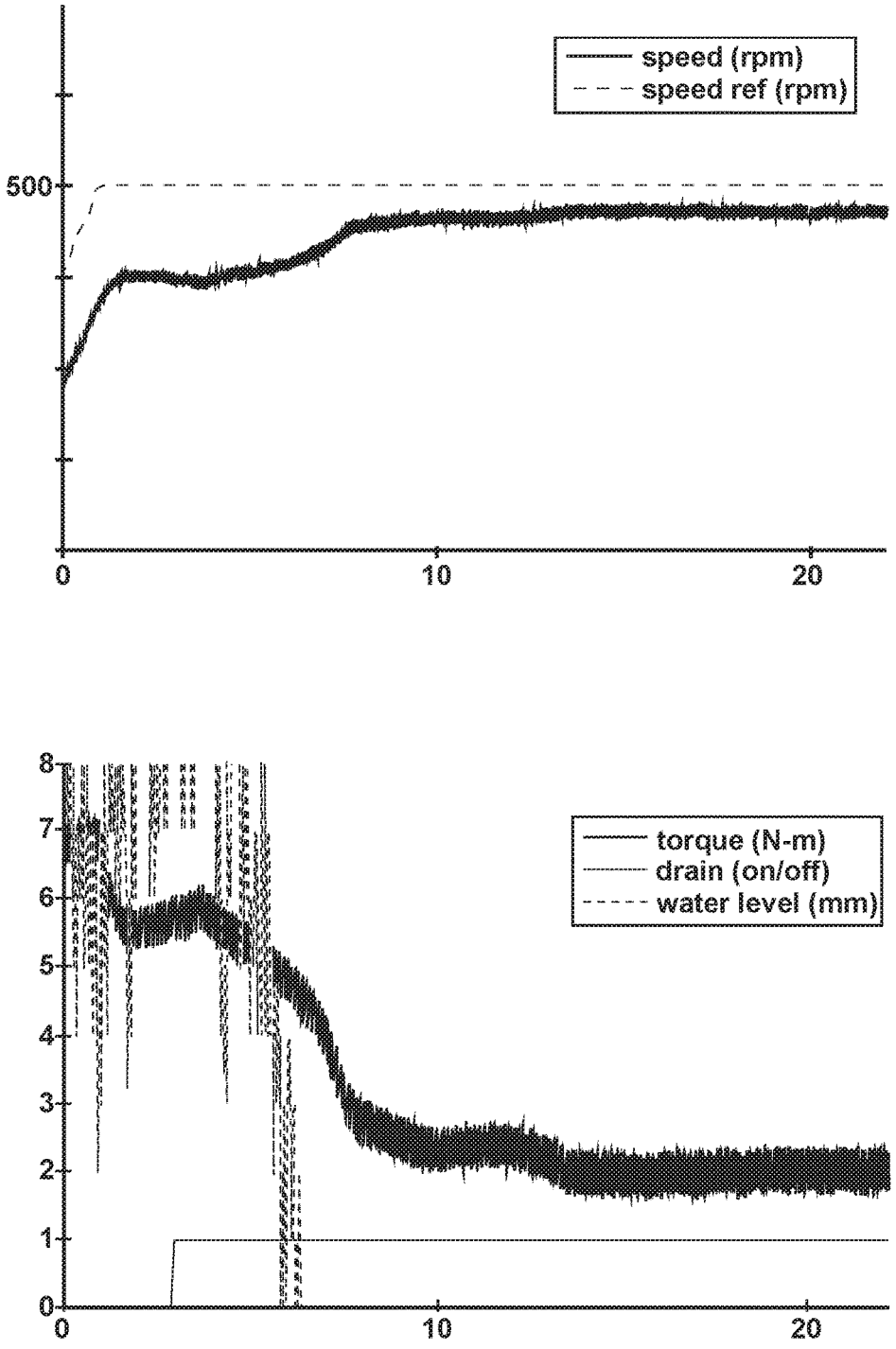
FIG. 14 is a plot illustrating basket speed, torque, water level, and drain pump operation.

Now we provide one practical example of a fluctuating drag event caused by switching on a machine component. FIG. 14 is an illustration of a drain pump 64 operation during an extraction profile. In this example, the drum 10 is initially at an acceleration phase with the drain pump off while the clothes are extracting water to increase the water level in the tub. Then, when the commanded speed reaches 500 rpm, the drum 10 enters a speed plateau, and a few seconds later, the drain pump is turned on. When the drain is turned on, the water level in the tub suddenly decreases as the water is pumped out, which causes a significant decrease in the rotational drag, which is reflected as a sudden drop on the torque provided by the motor. About 3-5 seconds after the pump is turned on, the torque level drops significantly, and about 10 seconds after the pump is turned on, torque reaches to a steady state nominal value. This is an illustrative example for showing the drag effects with drain pump activation, but similar drag effects can be induced by activation or deactivation of other machine components, such as other pumps, valves, nozzles etc.

These types of quick variations in the rotational drag and therefore the torque signal may be interpreted by the parameter estimation algorithm as variation in the load size, because the algorithm has no way of distinguishing between an increase in the rotational drag versus an increase in the load size until it is exposed to a sufficient amount of additional torque, drum acceleration, drum speed and/or drum angle data. Therefore, when a sudden, physical fluctuation occurs on rotational drag, it will impact the values obtained for estimated rotational friction components as well as estimated load inertia and estimated load unbalance.

Figure 15:
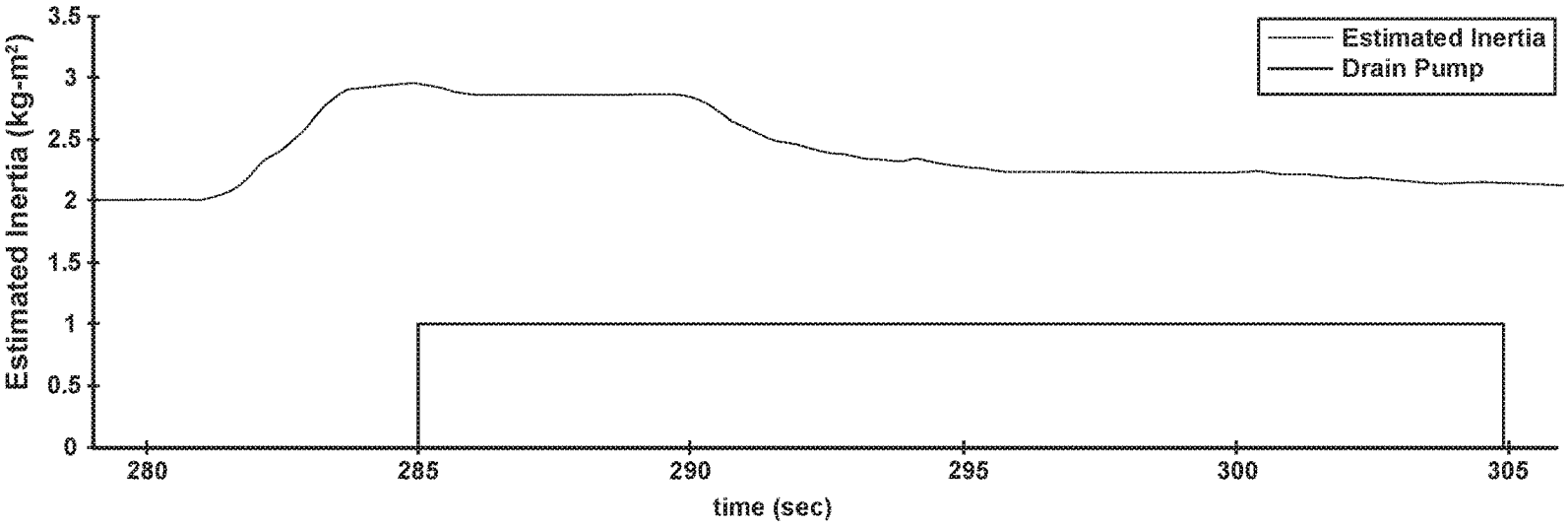
FIG. 15 is a plot illustrating typical behavior of inertia estimates in the presence of an abrupt change in the water drag.

Turning now to FIG. 15, the plot illustrates the typical behavior of the estimated inertia in the presence of large torque fluctuations induced by fluctuating water level in the tub. In the beginning few seconds of the figure, the estimated inertia value is 2 kg-m$^2$, which is the actual inertia value for the load of this example. Then, as the water extraction increases the water level in the sump, the viscous water drags start to increase, which is perceived as an increase in the load inertia by the parameter estimator. This increase is not physical; rather it is an estimation error caused by the torque increase due to the increase in rotational drag. Then, as the pump is turned on, the water starts to be pumped out, the drag decreases, and the estimated inertia starts to decrease towards the original level of 2 kg-m$^2$. However, convergence to within 10% of the actual value takes about 16 seconds after the drain pump 64 is turned on, and convergence to within 5% of the actual value takes more than 30 seconds after the drain pump 64 is turned on. Similar effects on other estimated parameters such as viscous and coulomb frictions or unbalance moment can also be observed in the presence of such drag fluctuations.

Figure 16:
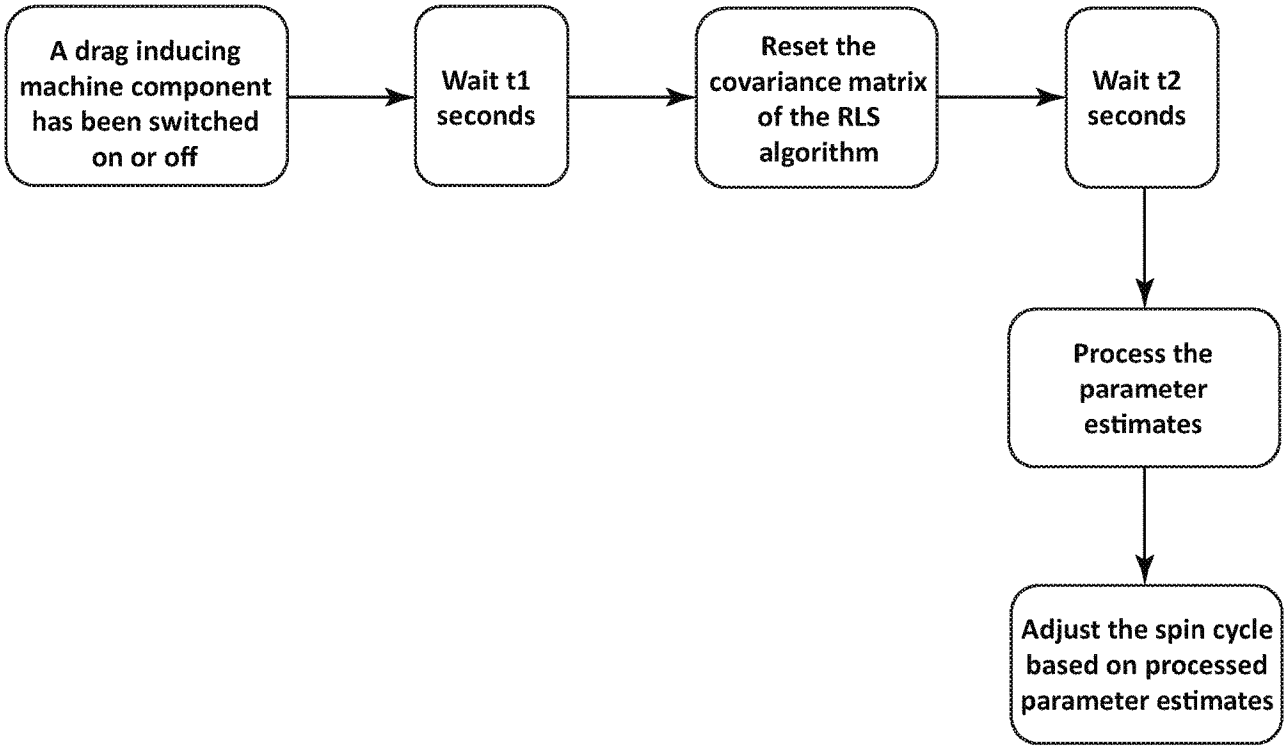
FIG. 16 is a plot illustrating a proposed algorithm consisting of a sequential set of events that essentially removes the effects of torque fluctuations that occur in inertia estimation when a drag-inducing machine component is switched on or off.

The disclosure herein proposes an algorithm for obtaining accurate parameter estimates, even in the presence of time-varying water drag caused by on/off operation of machine components mentioned above. FIG. 16 illustrates the proposed method of this disclosure, consisting of a sequential set of events that essentially removes the effects of the torque fluctuations that occur in parameter estimation when a machine component that affects the rotational drag is turned on or off. To address the torque fluctuation problem, the covariance resetting technique is employed t1 seconds after the machine component is switched on or off, where t1 is a design variable. Covariance resetting technique involves manually resetting the covariance matrix in the recursive least squares algorithm to a pre-determined positive-definite matrix. The choice of this matrix can be designed empirically. As was shown in FIG. 14 for the case of drain pump operation, it takes about 3 to 5 seconds until the torque fluctuation significantly reduces in response to a water drag decrease. Therefore, for the drain pump example, t1=3 or t1=5 seconds might be good design values for resetting the RLS covariance matrix. However, the amount of duration until the torque converges to a steady state level may depend on multiple factors, including which component of the machine is turned on/off, the speed at which it is turned on/off, and so on.

On the other hand, the covariance reset instructs the parameter estimation algorithm to forget all the data collected prior to the reset time t1, and to start estimating the parameters by using only the data collected after the reset time. The estimation algorithm then becomes robust to any torque or speed fluctuations that occurred before the reset time t1. After a covariance reset, the parameter estimation requires some data collection time, t2, in order for the parameter estimates to converge to their correct values. Data collection time may be in a range of 10 to 20 seconds in some examples of operation, but in general, t2 is another design variable that can be tuned based on empirical data. After this wait period, processing of the estimated parameter values begins. Processing may involve averaging or filtering a specific parameter estimate for t3 seconds of duration, where, again t3 is a design variable. The processed parameter estimation outputs can then be used to modify a cycle parameter, such as final spin speed, final spin duration, or final ramp acceleration rate.

Figure 17:
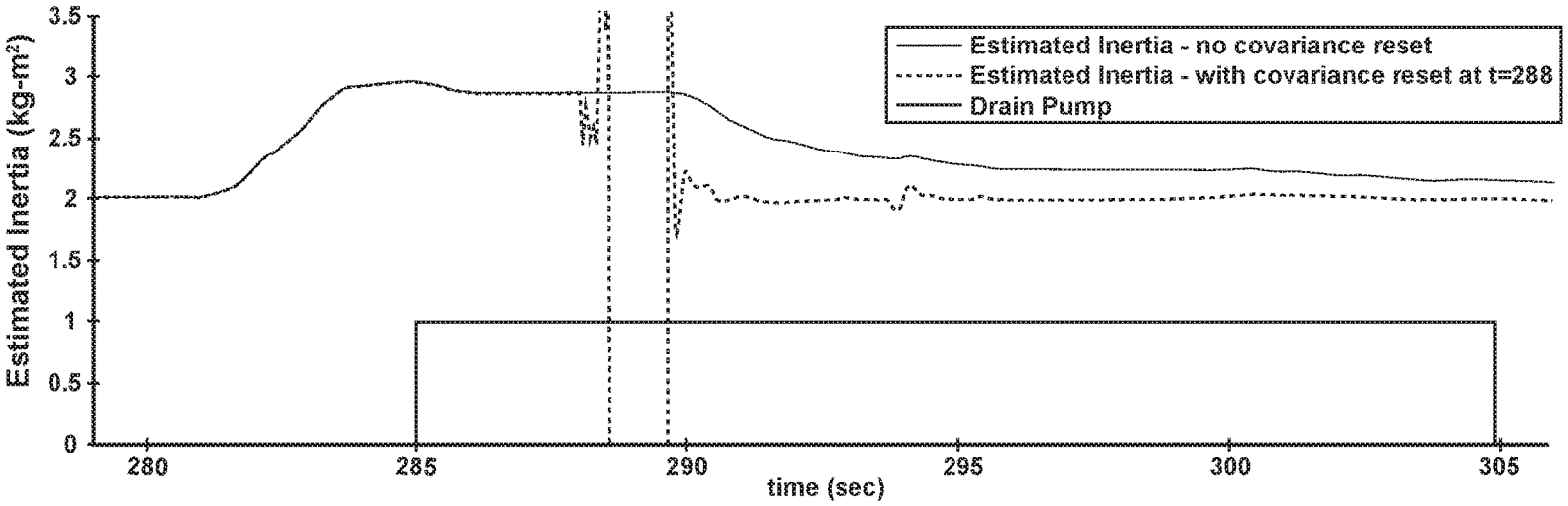
FIG. 17 is a plot illustrating an effect of applying the covariance resetting strategy after the pump is turned on when applied to the data of FIG. 17.

FIG. 17 illustrates an example to demonstrate the effect of applying the covariance resetting strategy. We use the same drain pump example that was demonstrated in FIG. 15 for comparison purposes, but the strategy can be applied to the operation of different machine components. In this example, the pump 64 is turned on at t=285, the covariance reset was applied at t=288, and thus with t1=3 seconds, to reset the covariance matrix to N*I, where N is a large number. In one example, the covariance matrix was reset to 1000*I, where I is the identity matrix. However, in general, the covariance matrix can be reset to any positive definite matrix. The choice of the covariance reset matrix can be done empirically or analytically by the use of the recursive least squares theory. FIG. 17 shows the estimated inertia response both with and without the covariance resetting with t1=3 seconds. The estimated inertia with the covariance reset converges within 5% of the actual inertia in about 2 seconds. Thus, the plot shows an enhancement algorithm to the parameter estimation model that mitigates the detrimental effects of fluctuating water drag on the estimated inertia due to the on/off operation of the drain pump 64 and allows the estimated inertia to converge to the actual value within a few seconds, rather than the 20-30 second delay observed without covariance resetting. In this example, since the 5% convergence time is about 2 seconds, t2 can be chosen to be 2, or a higher number, and the estimated inertia can be processed to make an adjustment in final spin speed, final spin duration, or final ramp rate, if such an adjustment is required.

Pseudo-Random Speed Reference Excitation Methods for Parameter Estimation

Parameter estimation in a washing machine 10 is used to identify a variety of load characteristics, including unbalance, inertia, and friction. Knowing these characteristics can be highly valuable for making decisions during various portions of the cycle, including water fill, washing, and the extraction phase. In order to identify these load characteristics, the system must be sufficiently excited. The invention of this disclosure provides methods for providing this excitation by way of the speed reference signal. The system is excited by providing pseudo-random signals to the reference speed input of the speed controller for the motor 80. The signal can be a white noise acceleration command or a binary sequence acceleration command that is then integrated to convert it to a speed reference.

Figure 18:
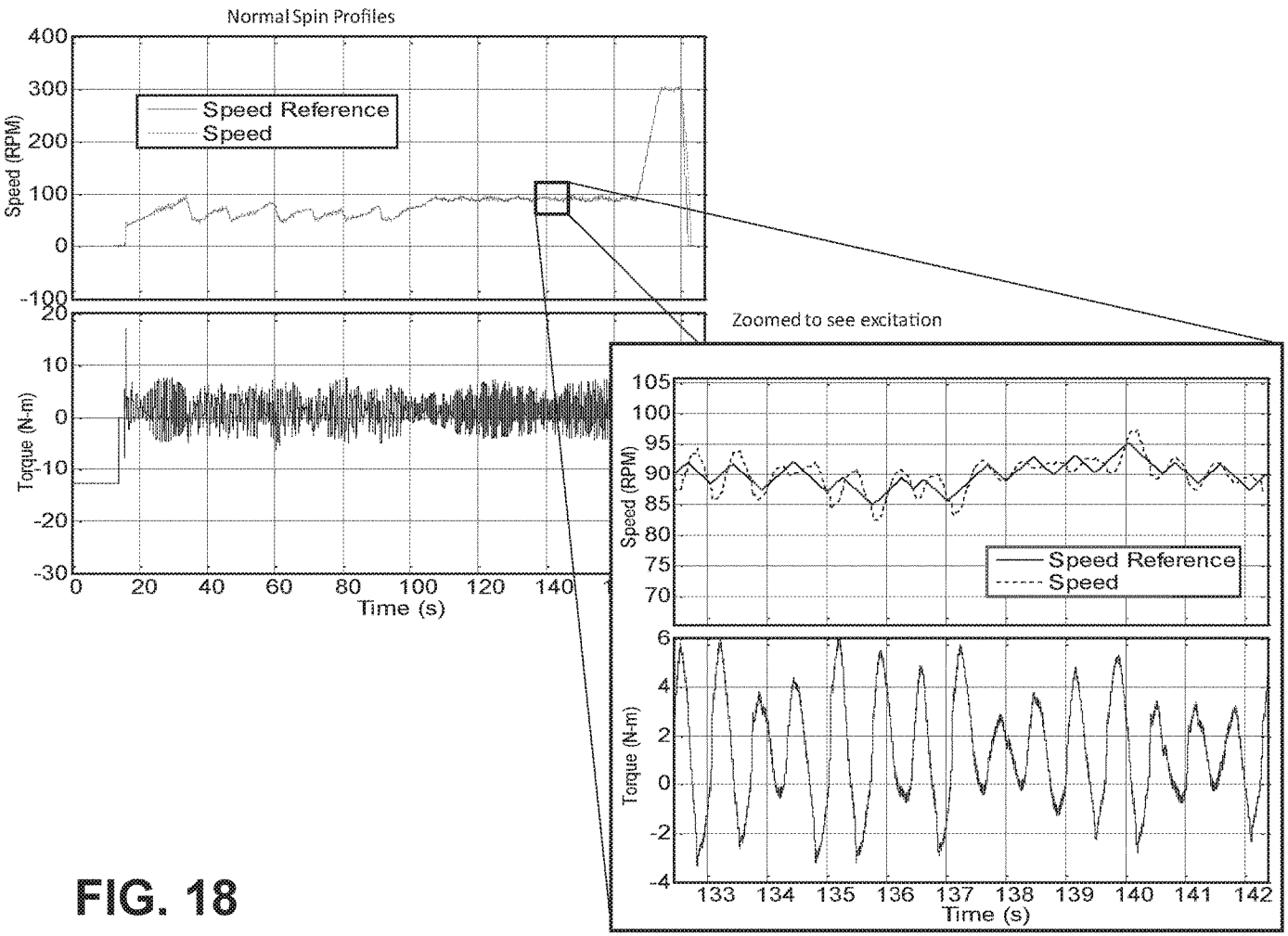
FIG. 18 is a plot and an enlarged view of a section of the plot illustrating excitation within a washing machine system following normal spin profiles.

FIG. 18 illustrates the presence of excitation within a system following normal spin profiles. Excitation refers to fluctuation of a system's input signal. In the example system described herein, the input signal is torque. However, it is inconvenient to directly impose torque excitation on a closed-loop system. A well-designed speed controller will substantially abate any imposed torque fluctuations, reducing the overall effect of the torque excitation. Since the motor 80 employs a speed controller, excitation can be imposed on the input of that controller, which is the speed reference signal. The fluctuation imposed on the speed reference signal will produce the required fluctuations in the torque signal.

Figure 19:
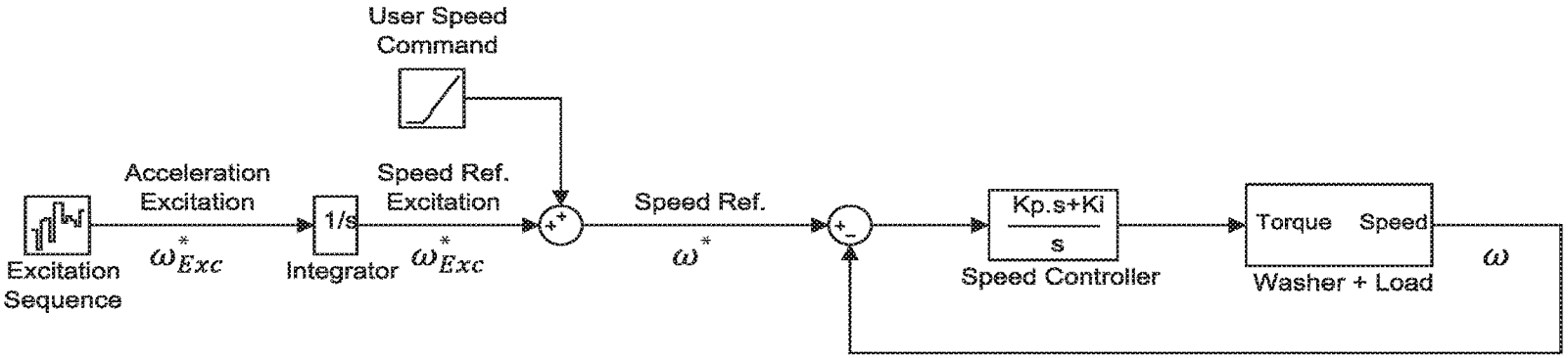
FIG. 19 is a schematic diagram of a control system for a washing machine in which excitation sequences are provided to a parameter estimation system and integrated to a speed reference for a speed controller.

FIG. 19 illustrates a block diagram of a control system for a washing machine 10 in which excitation sequences are provided to a parameter estimation system. Persistent excitation is a crucial component of parameter estimation, in order to achieve convergence of estimated parameters. The parameter estimator relies on using many measurements over time to infer n unknown parameters. These measurements must represent sufficiently different conditions for them to register as new information. That is, if the conditions in the system aren't changing, successive data points are nearly identical. The purpose of the excitation is to force different conditions on the system in order to enrich the information the parameter estimator gains from each successive data point. The result of well-tuned excitation is both fast convergence and noise immunity.

Figure 20:
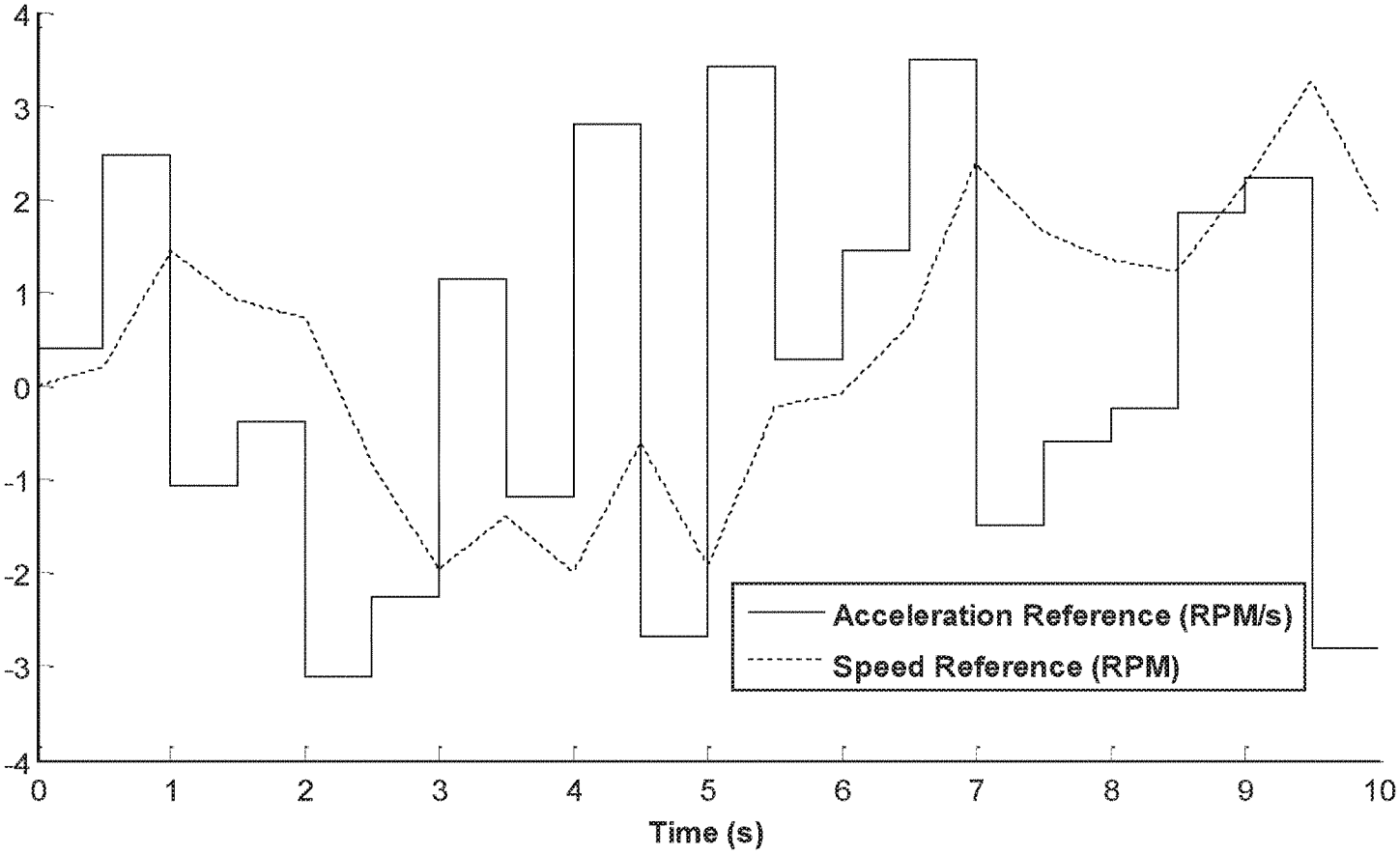
FIG. 20 is a plot illustrating excitation input using a white noise signal.

FIG. 20 illustrates a depiction of excitation using a white noise signal. From a purely theoretical standpoint, the best excitation signal is white noise, which is characterized by a uniform frequency spectrum in which all frequencies are in the same proportion. The first excitation signal considered in this disclosure is derived from a uniform white noise sequence. This white noise sequence can be applied as an acceleration command that is then integrated to provide a piecewise linear function that can be applied as the reference for the speed controller. The integration of the white noise sequence biases the content of the white noise sequence toward low frequencies, making the signal continuous as shown in the plot of FIG. 20. The acceleration sequence depicted herein is generated using the following logic for a fundamental period, $T_{WN}$:

$$\dot{\omega}_{Exc} \leftarrow A_{WN} * U[-1,1] \tag{6}$$

where, $A_{WN}$ is an amplitude and U[a,b] denotes a uniform random number in the interval [a,b].

As shown in FIG. 19, the speed reference results from the integration of the acceleration reference. The white noise excitation is tunable in both its amplitude and its fundamental period, $T_{WN}$, in order to suit each application. As further reference, the sequence of FIG. 19 was generated using $A_{WN}$=3.5 RPM/s and $T_{WN}$=0.5 s.

Figure 21:
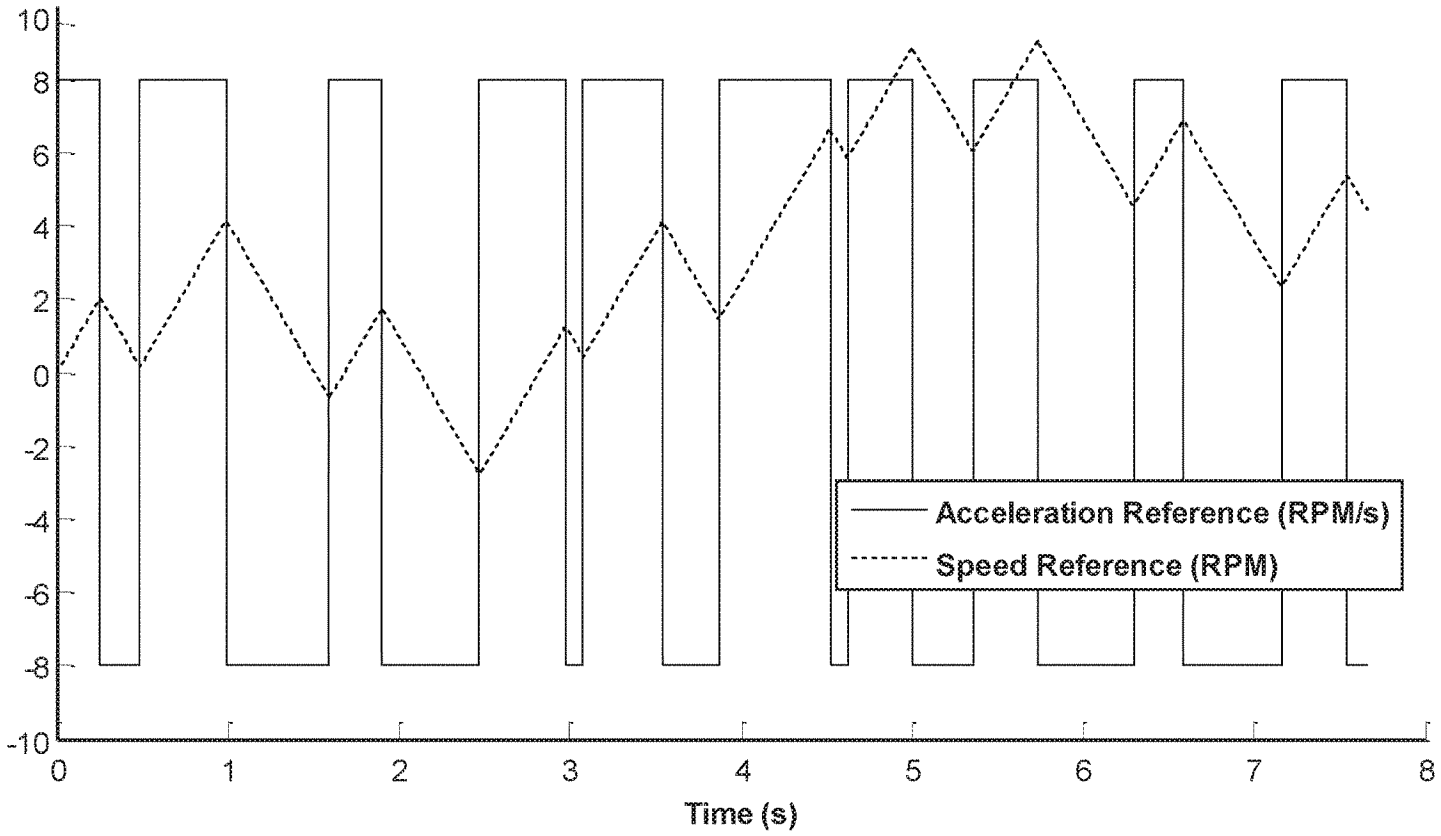
FIG. 21 is a plot illustrating excitation input using a pseudo-random binary sequence signal.

FIG. 21 illustrates a depiction of excitation using a pseudo-random binary sequence (PRBS) signal. The PRBS signal is also applied as an acceleration command, for the same reasons as described above regarding the white noise signal. The PRBS signal consists of a sequence that alternates between two fixed acceleration levels. The time between transitions is chosen as a uniform random number. The depicted sequence was generated using the following logic:

| | |
|---|---|
| Initialize $\dot{\omega}_{Exc}^* = A_{PRBS}$, $T_{Exc} = U[T_{min}, T_{PRBS}]$ | |
| Repeat | |
| Wait $T_{Exc}$; | Wait until hold time has expired |
| $\dot{\omega}_{Exc}^* \leftarrow -\dot{\omega}_{Exc}^*$ | Switch to the other acceleration level |
| $T_{Exc} \leftarrow U[T_{min}, T_{PRBS}]$ | Draw a new random time |

where, $T_{PRBS}$ is the maximum hold time and $A_{PRBS}$ is the amplitude of the sequence. $T_{min}$ is a fixed parameter representing the minimum hold time of the sequence. As previously described, the speed reference results from integrating the acceleration reference. The PRBS sequence is tunable in both the amplitude and the hold time. As further reference, the sequence in FIG. 21 was generated using $T_{PRBS}$=0.9 s and $A_{PRBS}$=8 RPM/s. $T_{min}$ is set to 0.1 s.

A Geometry Transformation Method to Compensate for Load Geometry Changes in the Estimation of Water Extraction Metrics In washing machine 10 systems, it is often useful to know how much water has been extracted from the laundry load. This information could be used to infer the status of any water mass remaining to be extracted in the drum 16 or to optimize cycle time by stopping the extraction phase after a predetermined amount of water has been extracted, among other uses. One way to measure water extraction is to measure the change in the mass of the load inside the drum 16, but this requires additional sensors such as load cells. Alternatively, mass can be estimated through moment of inertia estimation by using motor 80 signals, such as torque and speed. However, the moment of inertia of an object depends not only on the mass of the object, but also on the geometry and shape of the object. This can be a challenge in washing machine 10 systems because the load geometry changes as the basket spins up to high speeds, due to the centripetal acceleration of the load caused by rotational motion. As a result, at high speeds, the load geometry expands away from the motor shaft axis, and the moment of inertia of the load at high speeds becomes larger than the moment of inertia at low speeds, even if the load holds more water and is therefore heavier at low speeds. The invention disclosed herein provides the ability to compensate for the geometry changes and transform the moment of inertia at a certain speed to the moment of inertia that would be obtained with the same mass at a different speed. Therefore, it is possible to infer the extracted and/or remaining water mass by comparing the inertia at low speed to the inertia at high speed after applying the geometry transformation described herein.

Figure 22:
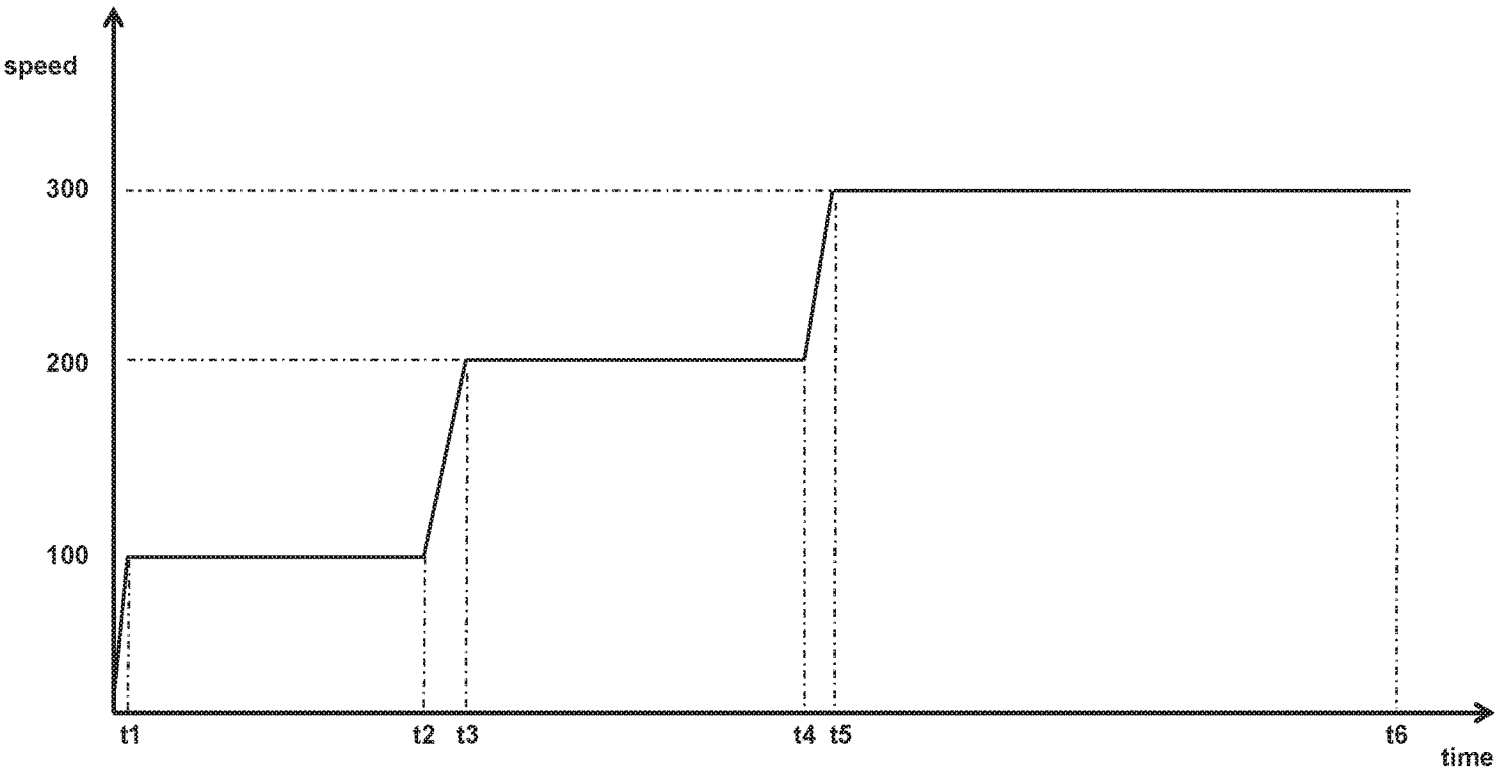
FIG. 22 is a plot illustrating an example of a spin profile.

The invention described herein uses an algebraic formula to transform the moment of inertia of the load at speed1 with geometry1 to the moment of inertia it would have at speed2 with geometry2, based on real-time estimation of load inertia using an online parameter estimation algorithm, such as recursive least squares parameter estimation. Referring now to FIG. 22, a plot depicting an example of a spin profile with three dwell times at three distinct speeds is provided. The dwell speeds 100, 200 and 300 are arbitrarily chosen for demonstration purposes only. The invention described herein can be applied at different dwell speeds with different dwell times. The extraction phase begins with completely saturated, wet clothes inside the drum 16. From t1 to t2, there is a dwell at 100 rpm. From t2 to t3, the spin speed ramps to 200 rpm. From t3 to t4, there is a dwell at 200 rpm, followed by a ramp up to 300 rpm from t4 to t5, with a dwell at 300 rpm from t5 to t6. For i={1, . . . , 6}, m(ti) represents the load mass at t=ti, while g(ti) describes the shape and geometry of the load, and J(ti) is the moment of inertia of the load. Within the context of this disclosure, it is assumed that the load mass is distributed such that the moment of inertia is linear in mass and can be represented by the following equation:

$$J(t)=m(t)*f(g(t)), \tag{8}$$

where it is also assumed that the water extraction during ramps is negligible compared to water extraction during dwells. These two assumptions are explained below.

The assumption represented by equation (8) holds for solid objects with uniform mass distribution. For example, moment of inertia of a solid cylinder around the longitudinal axis is given by the following equation:

$$J=0.5mr^2, \tag{9}$$

where, r=radius, m=mass of the cylinder, and thus J is linear in mass. As a further example, consider a cylindrical tube with inner radius r1, outer radius r2, and mass m, in which case the following equation can be used:

$$J=0.5m(r1^2+r2^2), \tag{10}$$

and the assumption represented by equation (8) still holds. In most cases, the moment of inertia of the clothes will approximate the moment of inertia of a cylindrical tube with outer radius being equal to the drum 16 radius, and inner radius satisfying the inequality 0<r1<drum radius.

In order for the assumption that water extraction during ramp phases is negligible to hold, the amount of time spent at ramps should be sufficiently lower than the amount of time spent at the dwells. For example, in FIG. 22, if t2–t1 is large enough so that the water extraction rate is close to zero at t=t2, and if the ramp rate between t2 and t3 is large enough so that t3–t2 is sufficiently small, then m(t2) will be nearly equal to m(t3). If the ramp rate is a limiting factor, the speed difference between the dwells could be reduced by adding an additional dwell or by increasing or decreasing the lower or higher speed dwell speed so that the dwell speeds are closer together and require less time to ramp to the next speed.

Figure 23:
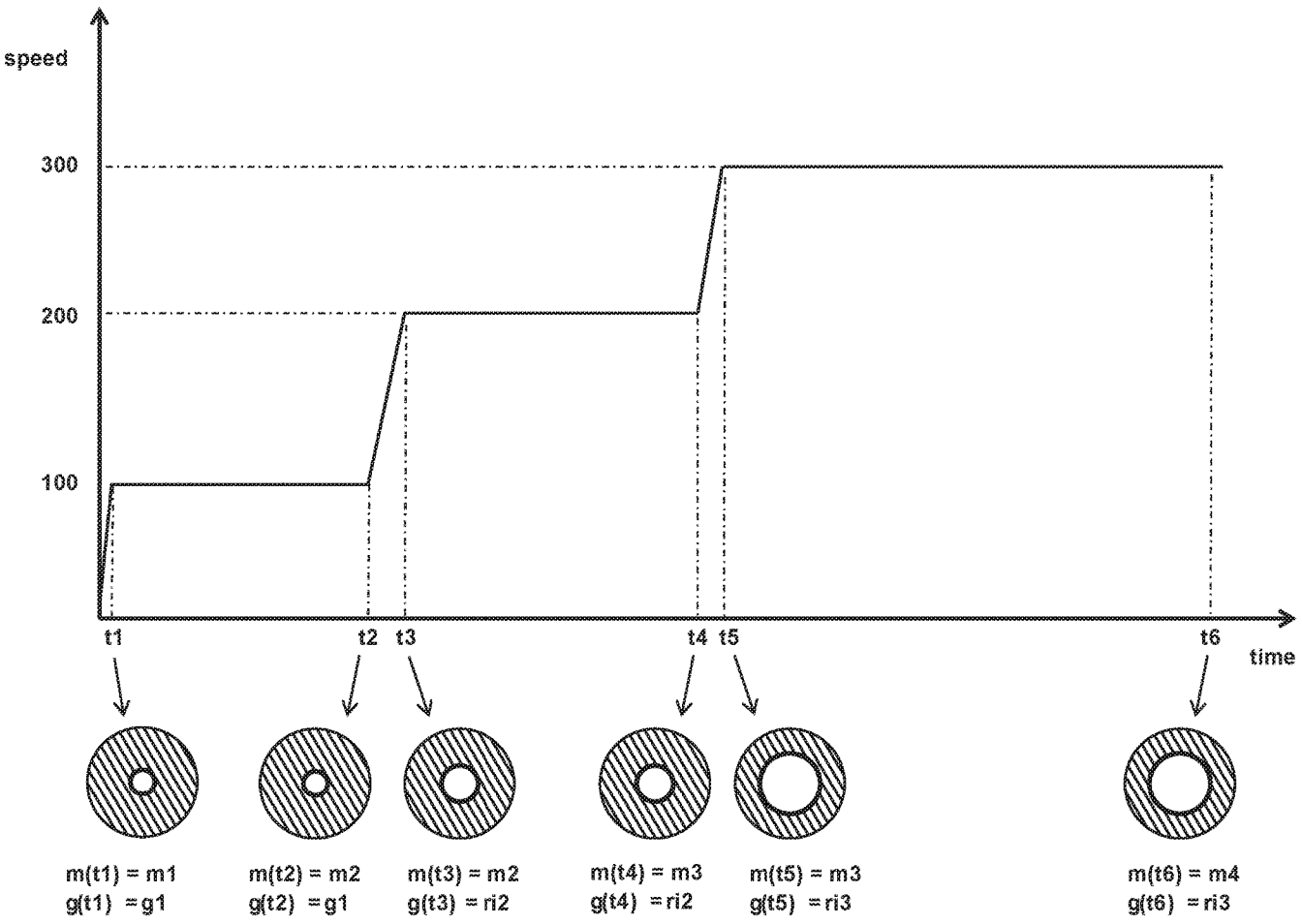
FIG. 23 is a plot illustrating clothes geometry during spin to show how the clothes will be distributed in the drum during dwells in the extraction phase.

Considering the spin profile illustrated in FIG. 22, the distribution of clothes in the basket will be different among different speeds. In this example, the clothes keep changing geometry until roughly 300 rpm. In general, the basket speed at which the clothes stop changing geometry depends on factors such as basket radius, fabric type, load mass and basket surface material. Referring now to FIG. 23, the clothes geometry during spin is illustrated to show how the clothes will be distributed in the drum 16 during the dwells at 100 rpm, 200 rpm, and 300 rpm. In the figure, the shaded disks represent the shape of the clothes within the drum 16 when viewed from the top. Due to water extraction, the mass of the clothes will be decreasing during the spin, but following the second assumption above, the mass at the end of the dwell is equal to the mass at the beginning of the consecutive dwell, and thus m(t2)=m(t3)=$m_2$ and m(t4)=m(t5)=$m_3$ as shown in FIG. 23. Furthermore, since the clothes do not change geometry during dwells, we have g(t1)=g(t2)=$g_1$, g(t3)=g(t4)=$g_2$, and g(t5)=g(t6)=$g_3$.

Hence, from the assumption of equation (8), the moment of inertia of the clothes at t1, . . . , t6 is given by:

$$\begin{aligned} J(t_1)&=m_1f(g_1)\\ J(t_2)&=m_2f(g_1)\\ J(t_3)&=m_3f(g_2)\\ J(t_4)&=m_3f(g_2)\\ J(t_5)&=m_3f(g_3)\\ J(t_6)&=m_4f(g_3) \end{aligned} \tag{11}$$

This allows for a geometric transformation which is the focus of the invention disclosed herein. With the geometric transformation, we can transform moment of inertia of the clothes among geometries at the three distinct speeds. For example, we can transform the moment of inertia of the clothes at the end of the 300 rpm dwell to the geometry of the preceding dwell time of the 200 rpm dwell as follows:

$$\hat{J}_{300}(t_6) = J(t_6)\frac{J(t_4)}{J(t_5)} = m_4 f(g_3)\frac{m_3 f(g_2)}{m_3 f(g_3)} = m_4 f(g_2) \tag{12}$$

where $\hat{J}_{300}$(t6) represents the moment of inertia that the clothes would have with mass m(t6)=$m_4$ that they have at the end of the 300 dwell, and the geometry distribution $g_2$ that they had at the 200 rpm dwell.

Using this method, a transformation can also be made between the dwells that are not consecutive. For example, the moment of inertia of the clothes at the end of the 300 rpm dwell can be further transformed to the geometry of the 100 rpm dwell by applying the transformation twice as follows:

$$\hat{J}_{100}(t_6) = J(t_6)\frac{J(t_4)J(t_2)}{J(t_5)J(t_3)} = m_4 f(g_3)\frac{m_3 f(g_2)m_2 f(g_1)}{m_3 f(g_3)m_2 f(g_2)} = m_4 f(g_1) \tag{13}$$

where, $\hat{J}_{100}(t_6)$ represents the moment of inertia that the clothes would have with mass m($t_6$)=$m_4$ that they have at the end of the 300 dwell, and the geometry distribution $g_1$ that they had at the 100 rpm dwell. In general, if the moment of inertia of the clothes in the beginning and at the end of the dwell is monitored and recorded using a parameter estimator, then, using these recorded inertia values, the moment of inertia from an arbitrary dwell can be transformed to the geometry of another arbitrary dwell using the technique shown above.

One practical application of the geometry transformation method described herein would be to eliminate the issues caused by the geometry inconsistencies in the estimation of the extracted water mass amount from the clothes during the extraction phase. Through the geometry transformation method described herein, load mass ratio between a low speed and a high speed can be calculated to obtain an extracted water mass amount as a percentage of the saturated wet load mass through the following equation:

$$EWM\ \text{Rate} = 100 * \left(1 - \frac{\hat{J}_{100}(t_6)}{J(t_1)}\right) \tag{14}$$

where $\hat{J}_{100}$(t6) and J(t1) are defined as in (11) and (13). Therefore, it follows from (11) and (13) that the EWM Rate (14) is equal to $$EWM\ \text{Rate} = 100 * \frac{m_{ew}}{m_1} \tag{15}$$

where $m_{ew}$ denotes the extracted water mass between the times t1 and t6. The EWM Rate can be used to modify an operation cycle parameter for purposes such as fabric type detection for cycle optimization, or water extraction monitoring for energy consumption optimization.

Initial Moisture Content Estimation for Dryer Using Parameter Estimation

Prior art dryers attempt to predict the remaining cycle time, and to end the dryer cycle when the correct dryness has been achieved. These objectives are currently accomplished based on information coming from sensors such as inlet/outlet thermistors, and connectivity strips that recognize when a wet item is in contact with the strips.

It will be apparent that prior art dryers have a limited capability to differentiate amounts of moisture content in the load, especially early in the cycle. This means the initial time-remaining prediction that the user sees on the dryer display can be less accurate due to lack of high resolution moisture information. Additionally, certain load cases create challenges when determining the time in which to end the dry cycle. This can result in sub-optimal dry performance (overly wet or dry).

Parameter estimation as disclosed herein provides a way to accurately predict, at the very beginning of the cycle, the time it will take to dry the load. This in turn provides benefit not only in the time-remaining accuracy that the user sees displayed, but also in the consistency of dryness at the end of the cycle.

It is assumed that information from the washing machine can be conveyed to the dryer via a connection such as but not limited to Wi-Fi or Bluetooth. Here, the information providing the new benefit comes from a parameter estimator running in embedded code in the washing machine. The parameter estimator has the ability to estimate inertia at many moments throughout the wash cycle. Knowing the combined inertia of the drum and the load, and knowing or assuming a geometry, inertia and be converted to mass, which is indicative of load size. Of course, conversion would be different based on whether the load were wet or dry, and at which speed the estimate is being done. Used intelligently, this information from the parameter estimator can provide knowledge that can optimize the dryer operation.

As described above, the estimated inertia can be obtained by running the parameter estimation algorithm prior to water being added to the load. This information can provide a reference point for the estimated inertia at the end of the dry process (i.e. this dry value is nearly equivalent to the desired value at the end of the dryer cycle). Additionally, this dry estimated inertia provides one of the inputs for calculating moisture content as will be described later. Knowing the estimated inertia independent of anything else can be used to avoid small-load failure modes in the dryer (e.g. avoid the assumption that few wet-hits from a connectivity sensor implies the load is dry in the case that the load is known to be small). In other words, the way in which the wet detections in the dryer is interpreted can change based on the knowledge of how big the load is. This can contribute to a reduction in wet loads at the end of the dry cycle.

The partially and fully saturated load inertia can be obtained by running the parameter estimation algorithm throughout the fill process up until the load has been made fully wet, but before the load has been spun to a speed where the water extracts from the clothing items. This absorbency information obtained from inertia changes as water is added can be used in conjunction with the dry load to understand the saturated wet-to-dry ratio of the load. Additionally this information can be used as an input to infer load type as described above which can reference a lookup table (in either the washer or dryer) to determine how much time a given load type/size will take to dry. It will be understood that one can estimate wet inertia not only during the fill process, but also at the start of a spin phase after washing, and before extracting significant water from the load. Moreover, combinations of wet inertia, dry inertia, and water volume can be used to infer load type and/or load size and, thus, drying parameters to be conveyed to a dryer.

To make an estimation of predicted dry time, the initial wetness condition the dryer will experience is another helpful input. A wetness condition is a metric that indicates the amount of water mass held by the clothes load. An example wetness condition metric is the RMC (remaining moisture content), which is a ratio of the water mass held by the clothes load to the dry load mass of the clothes load. This initial wetness condition can be obtained by estimating the load size after the washer has finished the final spin phase of the washer cycle. Following the washing machine spinning to maximum speed, a wet load size estimate can be obtained with the parameter estimator to get the combined inertia of the load plus the remaining moisture in the load. When this value is compared to the dry load size obtained prior to water being added, an estimate of the RMC can be calculated.

$$100*(\text{Load}_{extracted}-\text{Load}_{dry})/\text{Load}_{dry}=\text{RMC}, \tag{16}$$

where $\text{Load}_{extracted}$ can be either one of the inertia of the wet load, or mass of the wet load, and $\text{Load}_{dry}$ can be either one of the inertia of the dry load, or mass of the dry load and RMC is expressed as a percentage.

In order to accurately obtain the RMC value, there may be a need to compensate for the geometry shift of the load as described above. The load at maximum speed will have a significantly larger radius from the center of rotation than the dry load. This is a result of the high speeds forcing the clothes to the outer perimeter of the drum, whereas the dry load is more likely to have its mass taking up more of the drum volume. In application, the RMC may be calculated using geometry-compensated load size to avoid miscalculation due to geometry shifts.

$$100*(\text{Load}_{extracted}-\text{Load}_{dry(geo\ compensated)})/\text{Load}_{dry(geo\ compensated)}=\text{RMC} \tag{17}$$

where geometry compensation can be achieved by applying the geometry transformation method outlined in the previous section.

With the knowledge of the RMC in addition to the type of load, load size and mass of water, an estimate of the dryer time can be made. One method includes experimentally finding optimal dry times for an array of load sizes, load types and initial RMC values. These optimal dry times can be saved in an embedded lookup table or as a function. The inputs to the table or the function will be one or more of the values described above (dry load size, wet load size, and extracted load size). Additional inputs can come from inferring information such as load type which may be an additional function or lookup table based on these or other inputs. The lookup table(s) and/or function(s) can reside in the memory of the washer, the dryer, or both, or even some accessible memory external thereto, such as in a mobile device in communication with the washer or dryer.

By having all or some of the information described above, the dryer could either adjust the way that the existing techniques utilize the dryer's sensor information, or the dryer sensors may even be eliminated altogether to rely solely on the information provided by the washer's estimates. Examples of how existing techniques can be modified with this new information include weighting the dryer sensor information such that the sensors are relied upon more when they are likely to be accurate, and the estimates from the washer are relied upon more when the dryer sensors are likely to be inaccurate. Alternatively, the dryer may completely ignore sensor information in certain problematic loads (e.g. small loads), and rely on a combination of sensor and estimates (or just one or the other) in good loads. A good load may be considered one in which the sensors are known to work. By considering a version where dryer sensors are eliminated, a cost saving benefit arises potentially without negatively affecting the machine performance and perhaps improving the performance.

In summary, the information coming from the washer can provide a more accurate prediction of time-to-dry, even before the dry cycle begins. This capability is largely a result of load size, RMC, and load type information, all of which is not available at the beginning of the dry cycle today.

Secondly, this new information can provide improved consistency in the RMC at the end of the cycle. This benefit comes from having more specific knowledge about the load and its initial state.

Load Type Detection Using Absorbency from Real-Time Inertia Estimation

Knowing the type of load in a washing machine can provide a major benefit when it comes to adjusting the cycle for that load. The type of load may be characterized by the inertia and/or mass of the load and how these parameters respond as water is added to the load. This can include the inertia and/or mass when the load is completely dry at the start of the initial filling portion of the cycle, the inertia/mass when the load is completely dry at the start of the initial filling portion of the cycle, the inertia/mass when the load is completely saturated at the end of a filling cycle, and the inertia/mass at each intermediate between these points. For example, items made of similar fabrics, or items which absorb water in the same way may identify load types. Elements of the wash cycle that may be changed or adjusted according to the type of load include amounts of water during different cycles, spin speeds during extraction of water, speed profiles during rinse cycles, water temperatures during different cycles, type of wash profile (aggressive/calm), type of extraction profile including number of spins or spin attempts, number or duration of dwells during extraction, etc.

Currently, many cycle decisions in a washer or dryer are pre-defined by user-selected cycle and/or push-button modifiers coming from the user. In some cases modifiers are not configurable at all (e.g. duration of extraction plateaus). In some cases, if a user does not indicate preferred modifiers, the cycle will resort to the defaults. In other cases, cycle decisions can be based on load information, such as water fill volume, dry inertia, and unbalance estimations. One drawback of the prior art cycle determinations is that a cycle may not be optimized for a particular load due to lack of information. Additionally, it is not always considered desirable to have a large number of selectable modifiers due to perceived complexity, or confusion about what to choose. In many ways having a smart machine that can determine the best way to wash is an optimal future state that has not yet been achieved in the industry.

Using the parameter estimator described herein provides a way to approximate the type of load in the drum so that the cycle can be optimized for the specific load. The parameter estimator estimates the inertia of the clothes when the load is dry, then tracks the inertia change as water is added during the filling portion of the cycle. Different load types will have different properties of absorbency which can be recognized by monitoring the inertia as water is added. The inertia-water volume relationships for various loads can be used as signatures for determining load type as water is added to the load.

Beginning by knowing the dry inertia can provide an initial indication of the load size. However, knowing the dry load inertia is not sufficient to tell differences between similarly sized dry loads that are comprised of different materials. For example, two loads that have very similar dry weights may have very similar dry inertias if their densities are similar. However, as water is added, the more absorbent of the two loads will gain inertia more quickly than the less absorbent load. Additionally, the more absorbent load will have a larger final saturated inertia than the less absorbent load.

Consider the following two exemplary load types:

1) 10 lb. delicates load (minimally absorbent)–ideal cycle may target minimal fabric wear.
2) 10 lb. towel load (highly absorbent)–ideal cycle may target maximum cleaning performance.

Figure 24:
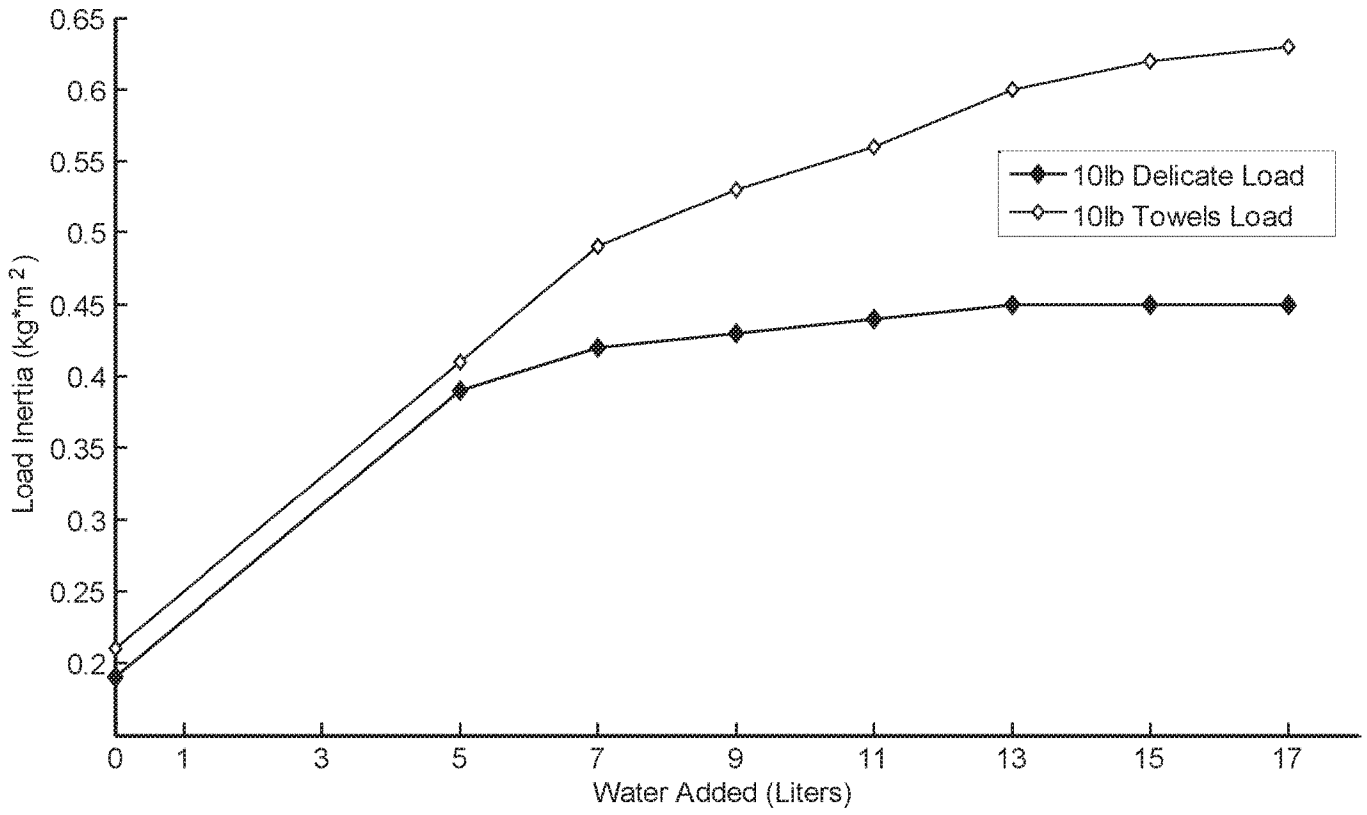
FIG. 24 is plot illustrating absorbency to distinguish load types.

A graph of exemplary inertia estimations for the foregoing loads from the parameter estimator is shown FIG. 24. In this example the inertia is checked periodically throughout the fill. Note that before any water has been added, the inertias of the two loads are very similar. Even at 5 liters of water, the inertias are nearly indistinguishable. However, as more water is added to both loads, there begins to be a clear differentiation between the signals. At some point before the Towels load, the Delicate load is no longer absorbing water, as can be seen where the inertia values no longer increase as additional water is added. Conversely, the Towels load continues to gain inertia as it absorbs water beyond the water volume at which the Delicates load has ceased gaining inertia due to water absorption. This plot provides an example of how differing load types can have distinguishable inertia-water volume signatures. Broadening this example to other load types can provide the information needed to adjust cycle behavior to adapt to different load types. In product application, inertia-water volume signatures could be saved in a lookup table and be linked to particular cycle modifications. This, in effect, would allow the cycle to be partially or totally modified based on a signature detected by the washing machine.

An expansion of this method includes having the cycle modification be a function of multiple inputs in addition to inertia-water volume signatures. Examples of additional inputs include readings from an APS sensor, geometry change/shift information as described above, unbalance/inertia angular position information from satellization speed detection as described above, or persistence of unbalance generation from parameter estimation. The latter reflects that some loads are consistently more difficult to evenly distribute, e.g. a single towel, a parameter that is observable by parameter estimation. All or some of these inputs may be used in a probabilistic model to predict with some confidence, the likelihood of a particular load type. This may be particularly valuable to ascertain load type differentiation beyond what is observable with absorbency alone.

One method includes monitoring the inertia continuously during the fill process. This means running the parameter estimation algorithm continuously throughout the water fill process. In the case of a vertical axis washer, this can be done at almost any drum speed including very slow speeds. In the case of a horizontal axis washer, the load must spin at a minimum speed such that the load is satellized.

Another method is to check the inertia periodically during the fill. In this method, the parameter estimation algorithm need only be running during the moments when inertia estimation is required. In the case of a horizontal axis washer, the inertia check can occur by temporarily moving up to a satellization speed, followed by reducing the speed once the inertia is estimated, and repeating this process throughout the fill. This may be desirable if filling at/above satellization speed is not preferred. In the case of a vertical axis washer, a similar approach can be used if there is a benefit to check inertia at higher speeds. An example may be that at higher speeds the load moves to a larger radius from the center of rotation, and when this occurs the inertia signal becomes larger and therefore the signal-to-noise improves.

In the case of a vertical axis washer, it may be more likely to have a solution that continuously monitors the inertia as opposed to periodically checking the inertia during the fill.

The reason is that lower speeds can be used to perform the inertia estimation in a vertical axis washer because there is no theoretical minimal speed in which the estimation can occur. Continuously monitoring inertia at low speeds may be beneficial because less water will be extracted from the load during the estimation. Less water being extracted can be beneficial when the objective is to estimate how much water is being absorbed by the load.

An additional benefit of this water absorbency detection method includes using the inertia estimation method to stop filling when the load is adequately saturated. As water is added, the inertia will increase until the load cannot absorb any additional water. When the load is saturated, the inertia will not increase as additional water is added. By detecting or predicting this plateau, the cycle can avoid adding too much or too little water. This is beneficial for cleaning performance optimization, cycle time, as well as resource/energy management.

As described, absorbency profiles can be used as signatures for load types. Common loads such as towels, jeans, and delicates have very different load absorbencies, even though in some cases their dry mass and/or dry inertia may be very similar. By differentiating these loads, wash cycles can be automatically modified to enable optimal adaptation and cycle performance as well as dramatically reduce the steps and complexity that the user experiences.

Utilizing the aforementioned methods of the embodiments described herein, values obtained from a parameter estimator can be used to improve and optimize the cycles of operation of a washing machine 10 in a variety of ways. As such, the above-described embodiments provide a variety of benefits including that the energy consumption rate of the laundry treating appliance can be improved and the operation cycle of the washer can be adjusted based on water extraction monitoring.

Additionally, it should be appreciated that the aforementioned methods within a horizontal or vertical axis washing machine are exemplary, and use within alternative appliances are contemplated. The methods can alternatively be utilized in additional laundry treating appliances such as a combination washing machine and dryer, a tumbling refreshing/revitalizing machine, an extractor, and a non-aqueous washing apparatus, in non-limiting examples.

The above-described embodiments are more accurate and precise as compared to the existing solutions, as the determination are driven directly by the optimal conditions for operation of the washing machine 10. Furthermore, the above-described embodiments offer solutions that continuously provide information about the operation of the washing machine 10, rather than relying on an extrapolation, which fails to capture the true behavior of the washing machine.

To the extent not already described, the different features and structures of the various embodiments can be used in combination with each other as desired. That one feature is not illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A laundry treating appliance comprising:

a drum at least partially defining a treating chamber for receiving a laundry load for treatment according to a cycle of operation;

a motor operably coupled with the drum to rotate the drum;

a controller coupled to the motor and configured to control the motor and determine at least one input sensed from the motor; and a processor operably coupled with the controller and having a parameter estimator configured to estimate parameter values of the laundry load based upon the at least one input;

wherein the processor is configured to send an excitation signal to the controller that randomly fluctuates an acceleration command to affect acceleration of the motor while the parameter values of the laundry load are estimated, and the cycle of operation is adjusted based on the estimated parameter values of the laundry load.

2. The laundry treating appliance of claim 1 wherein the excitation signal is tunable in amplitude.

3. The laundry treating appliance of claim 1 wherein the excitation signal is tunable in duration.

4. The laundry treating appliance of claim 1 wherein the excitation signal is derived from a uniform white noise sequence.

5. The laundry treating appliance of claim 4 wherein the uniform white noise sequence is generated by a logic for a fundamental period comprising:

$$\dot{\omega}^*_{Exc} \leftarrow A_{WN} * U[-1,1]$$

where $A_{WN}$ is an amplitude, $\dot{\omega}$*Exc is the excitation signal, and U[a,b] denotes a uniform random number in an interval [a,b].

6. The laundry treating appliance of claim 4 wherein the excitation signal is tunable in amplitude.

7. The laundry treating appliance of claim 4 wherein the excitation signal is tunable in duration.

8. The laundry treating appliance of claim 4 wherein the white noise sequence is integrated to be converted to a speed reference.

9. The laundry treating appliance of claim 8 wherein the integrating of the white noise sequences biases the white noise sequence toward low frequencies.

10. The laundry treating appliance of claim 9 wherein the biasing of the white noise sequence toward low frequencies results in a continuous signal.

11. The laundry treating appliance of claim 1 wherein the excitation signal is derived from a pseudo-random binary sequence.

12. The laundry treating appliance of claim 11 wherein the binary sequence alternates between two fixed acceleration levels.

13. The laundry treating appliance of claim 11 wherein the pseudo-random binary sequence is generated by a logic comprising:

$$\text{Initialize } \dot{\omega}^*_{Exc} = A_{PRBS}, T_{Exc} = U[T_{min}, T_{PRBS}];$$

Repeat:

Wait $T_{Exc}$, Wait until a hold time has expired;

$W^*_{Exc} \leftarrow -\dot{\omega}_{Exc}$, Switch to an other acceleration level;

$T_{Exc} \leftarrow U[T_{min}, T_{PRBS}]$, Draw a new random time;

where $\dot{\omega}^*_{Exc}$ is the excitation signal, $T_{Exc}$ is an excitation time, U is a uniform random number, $T_{PRBS}$ is a maximum hold time, $A_{PRBS}$ is an amplitude of the sequence, and $T_{min}$ is a fixed parameter representing a minimum hold time of the sequence.

14. The laundry treating appliance of claim 11 wherein the binary sequence is integrated to be converted to a speed reference.

15. The laundry treating appliance of claim 11 wherein the excitation signal is tunable in duration.

16. The laundry treating appliance of claim 15 wherein the binary sequence alternates between two fixed acceleration levels.

17. The laundry treating appliance of claim 1 wherein estimating the parameter values utilizes a model comprising:

$$\tau = J\dot{\omega} + b\omega + c + A\sin(\alpha+\beta)$$

wherein T=torque, J=inertia, $\dot{\omega}$=acceleration of the drum, ω=rotational speed of the drum, b=viscous friction, c=coulomb friction, A=amplitude of a basket speed first harmonic torque disturbance, which may be a function of an unbalance mass, surface tilt angle, gravitational acceleration, unbalance mass position, and basket speed, α=rotational position of the drum, and β=rotational position of an imbalance of the laundry load relative to the rotational position of the drum.

18. The laundry treating appliance of claim 1 wherein the at least one input is one of a torque of the motor, an acceleration of the drum, a rotational speed of the drum, or an angular position of the drum.

19. The laundry treating appliance of claim 1 wherein the excitation signal is provided by way of a speed reference signal.

20. The laundry treating appliance of claim 19 wherein the excitation signal is provided to a reference speed input of the controller.

* * * * *